US009901774B2

(12) United States Patent
Miller et al.

(10) Patent No.: US 9,901,774 B2
(45) **Date of Patent: *Feb. 27, 2018**

(54) ELLIPTICAL EXERCISE DEVICE

(71) Applicants: Larry D. Miller, Rochester, MI (US); Bradley Jordan Miller, Royal Oak, MI (US)

(72) Inventors: Larry D. Miller, Rochester, MI (US); Bradley Jordan Miller, Royal Oak, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/009,163

(22) Filed: Jan. 28, 2016

(65) Prior Publication Data

US 2016/0151664 A1 Jun. 2, 2016

Related U.S. Application Data

(63) Continuation of application No. PCT/US2015/034146, filed on Jun. 4, 2015, which is (Continued)

(51) Int. Cl.
*A63B 22/00* (2006.01)
*A63B 22/06* (2006.01)

(Continued)

(52) U.S. Cl.
CPC .... *A63B 22/0664* (2013.01); *A63B 21/00069* (2013.01); *A63B 21/151* (2013.01); *A63B 21/4034* (2015.10); *A63B 21/4035* (2015.10); *A63B 21/4049* (2015.10); *A63B 22/001* (2013.01); *A63B 22/0015* (2013.01); *A63B 22/0017* (2015.10); *A63B 22/0056* (2013.01); *A63B 22/04* (2013.01); *A63B 23/03591* (2013.01); *A63B 21/005* (2013.01); *A63B 21/015* (2013.01); *A63B 21/154* (2013.01); *A63B 21/225* (2013.01); *A63B 24/0087* (2013.01); *A63B 2022/002* (2013.01);

(Continued)

(58) Field of Classification Search
USPC ..... 482/1–148
See application file for complete search history.

(56) References Cited

U.S. PATENT DOCUMENTS 5,577,985 A * 11/1996 Miller ..... A63B 21/00178 482/51
5,611,756 A * 3/1997 Miller ..... A63B 21/00178 482/51

(Continued)

FOREIGN PATENT DOCUMENTS

AU 2007202574 A1 1/2009

*Primary Examiner* — Stephen Crow
(74) *Attorney, Agent, or Firm* — Dinsmore & Shohl LLP

(57) ABSTRACT

An elliptical exercise device has a frame supporting guide links and foot support links. A cam system has a vertical control cam portion. Vertical control followers are pivotally connected to a vertical follower support. Mechanical vertical control couplings couple the foot support links to the vertical control followers. A foot receiving area of each foot support link moves in a generally elliptical path when the cam portion rotates about the cam axis.

19 Claims, 21 Drawing Sheets

Related U.S. Application Data a continuation of application No. 14/643,587, filed on Mar. 10, 2015, now Pat. No. 9,072,936, said application No. PCT/US2015/034146 is a continuation of application No. 14/643,522, filed on Mar. 10, 2015, now Pat. No. 9,061,175.

(60) Provisional application No. 62/086,470, filed on Dec. 2, 2014.

(51) Int. Cl.

| | |
|---|---|
| ***A63B 21/00*** | (2006.01) |
| ***A63B 22/04*** | (2006.01) |
| ***A63B 23/035*** | (2006.01) |
| *A63B 21/005* | (2006.01) |
| *A63B 21/015* | (2006.01) |
| *A63B 21/22* | (2006.01) |
| *A63B 24/00* | (2006.01) |

(52) U.S. Cl.

CPC ..... *A63B 2022/0676* (2013.01); *A63B 2022/0682* (2013.01); *A63B 2220/803* (2013.01)

(56) References Cited

U.S. PATENT DOCUMENTS 5,788,610 A * 8/1998 Eschenbach ..... A63B 22/001 482/51
5,911,649 A 6/1999 Miller
5,911,849 A * 6/1999 Bradshaw ..... B26D 7/088 118/243
5,957,814 A * 9/1999 Eschenbach ..... A63B 22/001 482/51
6,019,710 A * 2/2000 Dalebout ..... A63B 22/0664 482/51
6,045,487 A * 4/2000 Miller ..... A63B 21/00178 482/51
6,113,518 A 9/2000 Maresh et al.
6,113,618 A * 9/2000 Nic ..... A61B 17/14 30/351
6,126,574 A * 10/2000 Stearns ..... A63B 22/001 482/52
6,689,119 B1 2/2004 Di Caprio et al.
6,758,790 B1 * 7/2004 Ellis ..... A63B 22/001 482/52
6,889,119 B2 * 5/2005 Riff ..... B25J 9/046 414/696
6,929,587 B2 * 8/2005 Charnitski ..... A63B 21/15 482/110
7,052,438 B2 * 5/2006 Eschenbach ..... A63B 22/001 482/51
7,101,316 B2 * 9/2006 Rosenow ..... A63B 22/0017 482/52
7,160,230 B2 * 1/2007 Tremblay ..... A63B 21/157 482/52
7,169,089 B2 1/2007 Rodgers, Jr.
7,169,090 B1 1/2007 Maresh
7,172,531 B2 * 2/2007 Rodgers, Jr. ..... A63B 22/001 482/52
7,189,090 B2 * 3/2007 Aizawa ..... H01R 12/62 439/260
7,201,705 B2 * 4/2007 Rodgers, Jr. ..... A63B 22/001 482/52
7,214,168 B2 * 5/2007 Rodgers, Jr. ..... A63B 22/001 482/52
7,223,209 B2 * 5/2007 Lee ..... A63B 22/001 482/52
7,462,134 B2 * 12/2008 Lull ..... A63B 22/0015 482/52
7,556,591 B2 * 7/2009 Chuang ..... A63B 22/001 482/51
7,591,761 B1 * 9/2009 Ellis ..... A63B 21/22 482/52
7,651,445 B1 * 1/2010 Chen ..... A63B 22/001 482/51
7,678,025 B2 3/2010 Rodgers, Jr.
7,708,668 B2 * 5/2010 Rodgers, Jr. ..... A63B 21/154 482/51
7,749,137 B2 * 7/2010 Watt ..... A63B 22/0017 482/52
7,758,473 B2 7/2010 Lull et al.
7,794,362 B2 9/2010 Miller
7,794,382 B2 * 9/2010 Cheich ..... B31D 5/0043 206/409
7,828,698 B2 11/2010 Rodgers, Jr.
7,828,898 B2 * 11/2010 Maeda ..... C23C 16/45512 118/715
7,841,968 B1 * 11/2010 Eschenbach ..... A63B 21/225 482/52
7,878,025 B2 * 2/2011 Rydlewicz ..... A44C 17/001 63/26
7,938,754 B2 * 5/2011 Eschenbach ..... A63B 22/001 482/52
8,029,416 B2 * 10/2011 Eschenbach ..... A63B 22/0017 482/52
8,062,187 B2 * 11/2011 Lull ..... A63B 21/154 482/51
8,092,351 B1 * 1/2012 Rodgers, Jr. ..... A63B 21/00181 482/51
8,133,159 B2 * 3/2012 Eschenbach ..... A63B 21/00069 482/52
8,303,470 B2 * 11/2012 Stewart ..... A63B 22/001 482/51
8,317,663 B2 11/2012 Stewart et al.
8,597,161 B2 * 12/2013 Dibble ..... A63B 22/0015 482/52
8,663,072 B2 3/2014 Stewart et al.
8,668,627 B2 * 3/2014 Eschenbach ..... A63B 21/00069 482/51
8,740,754 B2 * 6/2014 Miller ..... A63B 22/001 482/51
8,974,352 B2 * 3/2015 Eschenbach ..... A63B 22/0017 482/51
8,979,714 B2 * 3/2015 Miller ..... A63B 22/04 482/51
9,061,175 B1 * 6/2015 Miller ..... A63B 22/0664
9,192,809 B1 * 11/2015 Miller ..... A63B 21/0087
2001/0016541 A1 * 8/2001 Maresh ..... A63B 22/001 482/52
2004/0043871 A1 * 3/2004 Chang ..... A63B 22/001 482/52
2006/0172865 A1 * 8/2006 Dey ..... A63B 22/0007 482/52
2007/0037667 A1 * 2/2007 Gordon ..... A63B 22/0017 482/51
2012/0108402 A1 * 5/2012 Rodgers, Jr. ..... A63B 21/155 482/110
2012/0178589 A1 * 7/2012 Eschenbach ..... A63B 21/00069 482/52
2012/0277066 A1 * 11/2012 Hsu ..... A63B 22/001 482/57
2013/0012363 A1 * 1/2013 Eschenbach ..... A63B 21/00069 482/52
2013/0210578 A1 * 8/2013 Birrell ..... A63B 71/0622 482/4
2014/0051552 A1 * 2/2014 Habing ..... A63B 21/154 482/52
2014/0148311 A1 * 5/2014 Eschenbach ..... A63B 22/0017 482/52
2014/0296036 A1 * 10/2014 Miller ..... A63B 22/001 482/52
2014/0336006 A1 * 11/2014 Miller ..... A63B 21/154 482/52

(56) References Cited

U.S. PATENT DOCUMENTS

| | | | | |
|---|---|---|---|---|
| 2015/0182787 | A1* | 7/2015 | Liu | A63B 22/001 482/52 |
| 2015/0335943 | A1* | 11/2015 | Miller | A63B 22/0664 482/52 |
| 2016/0059067 | A1* | 3/2016 | Miller | A63B 21/154 482/52 |

* cited by examiner

ELLIPTICAL EXERCISE DEVICE

CROSS-REFERENCE TO RELATED APPLICATIONS

This application is a continuation of international patent application Serial No. PCT/US2015/034146, filed Jun. 4, 2015, which claims priority from U.S. patent application Ser. No. 14/643,587, filed Mar. 10, 2015 and U.S. patent application Ser. No. 14/643,522, filed Mar. 10, 2015, both of which claim priority to U.S. provisional patent application Ser. No. 62/086,470 filed Dec. 2, 2014. In addition, application Serial No. PCT/US2015/034146 claims priority to U.S. provisional patent application Ser. No. 62/086,470, filed Dec. 2, 2014. The contents of all of which are incorporated herein by reference in their entirety.

FIELD OF THE INVENTION

This invention relates to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links are pivotally supported on a frame and a foot engaging link is supported at the lower end of each guide link. An intermediate link connects each guide link to crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control member engages each foot link and extends up and over a pulley located at the guide link pivot axis. The control members connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

SUMMARY OF THE INVENTION

The present invention provides multiple embodiments of exercise devices. According to one embodiment, an elliptical exercise device has a frame configured to be supported on a horizontal surface, the frame having a first pivot axis defined thereon. A first and a second guide link each has a first and a second attachment point defined thereon. Each guide link is pivotally attached, through its first attachment point, to the frame at the first pivot axis thereof. A first and a second foot support link each has a foot receiving area configured to support a user's foot thereupon. Each foot support link is pivotally connected to the second attachment point of a respective one of the guide links so that when the guide links pivot relative to the frame, they each cause the respective foot receiving area to move in a path of travel having a horizontal component of motion. A cam system has a horizontal control cam portion supported for rotation about a cam axis, the horizontal control cam portion having a first and second offset horizontal drive portion. A horizontal follower support is disposed on the frame and has a horizontal follower pivot axis defined thereon. A first and a second horizontal control follower are pivotally connected to the horizontal follower support at the horizontal follower pivot axis. Each horizontal control follower has a control portion and a cam engagement portion, the cam engagement portion having a cam engagement surface engaging a respective one of the offset horizontal drive portions of the horizontal cam portion such that as the horizontal cam portion rotates about the cam axis, the offset horizontal drive portions cause the horizontal control followers to pivot back and forth about the horizontal follower pivot axis thereby causing the control portions to oscillate back and forth. A first and a second mechanical horizontal control coupling each couples a respective one of the guide links to the control portion of a respective one of the horizontal control followers such that as the horizontal cam portion rotates about the cam axis, the mechanical horizontal control couplings pivot the guide links about the first pivot axis, thereby moving the foot receiving areas of the foot support links in a path of travel having a horizontal component of motion. A vertical drive system is mechanically coupled to the foot support links so as to move the foot receiving areas of the foot support links in a path of travel having a vertical component of motion. Movement of each foot receiving area in the path of travel having a vertical component of motion is generally out of phase with the movement in the path of travel having a horizontal component of motion such that when the horizontal component of motion of each foot receiving area is at its forwardmost or rearwardmost limit, the vertical component of motion of the same foot receiving area is approximately midway between its uppermost and lowermost limit. The foot receiving area of each foot support link moves in a generally elliptical path when the cam portion rotates about the cam axis.

In some versions, the horizontal follower support is a movable support operable to move the horizontal follower pivot axis relative to the cam axis so as to alter a range of travel of the control portion of the horizontal control followers, thereby altering a range of the path of travel having a horizontal component of motion. A horizontal control actuator is operable to move the movable horizontal control follower support.

In certain versions, the horizontal follower support is a horizontal follower support link having a frame end pivotally connected to the frame and a follower end defining the horizontal follower pivot axis. The horizontal follower support link is pivotable about the frame end so as to move the horizontal follower pivot axis relative to the cam axis. In other versions, the horizontal follower support is linearly displaceable on the frame.

In some versions, the vertical drive system has a crank supported for rotation about a crank axis and a first and a second mechanical vertical control coupling each coupling a respective one of the foot support links to the crank such that as the crank rotates about the crank axis, the mechanical vertical control couplings move the foot receiving areas of the foot support links in the path of travel having the vertical component of motion. The cam system may include a crank portion defining the crank and the crank axis may be the cam axis. The first and second mechanical vertical control couplings may be flexible couplings each having one end coupled to the crank and an opposite end coupled to the respective foot support link, each flexible coupling having a midportion extending over a guide disposed on the frame rearward of the first pivot axis.

The horizontal control followers may be elongated elements. In one version, each has one end pivotally connected to the horizontal follower support, an opposite end defining the control portion, and a midportion defining the cam engagement portion. In a second version, each has one end pivotally connected to the horizontal follower support, an opposite end defining the cam engagement portion, and a midportion defining the control portion. In a third version, each has one end defining the cam engagement portion, an opposite end defining the control portion, and a midportion pivotally connected to the horizontal follower support. The cam engagement portion of each elongated horizontal control follower may be a slot defined in the elongated element.

In some versions, the first and second mechanical horizontal control couplings are horizontal control links each having one end coupled to the control portion of the respective one of the horizontal control followers and a second end connected to a respective one of the guide links.

In some versions, each of the guide links further includes a hand portion extending upwardly from the first attachment point.

In certain versions, the device includes an adjustable resistance element coupled to the cam system.

According to another embodiment of the present invention, an elliptical exercise device has a frame configured to be supported on a horizontal surface with a first pivot axis defined on the frame. A first and a second guide link each has a first and a second attachment point defined thereon, each guide link being pivotally attached, through its first attachment point, to the frame at the first pivot axis thereof. A first and a second foot support link each has a foot receiving area configured to support a user's foot thereupon. Each foot support link is pivotally connected to the second attachment point of a respective one of the guide links so that when the guide links pivot relative to the frame, they each cause the respective foot receiving area to move in a path of travel having a horizontal component of motion. A cam system has a vertical control cam portion and a horizontal control cam portion, the cam portions supported for rotation about cam axes. The vertical control cam portion has a first and a second offset vertical drive portion. The horizontal control cam portion has a first and second offset horizontal drive portion. A vertical follower support is disposed on the frame and has a vertical follower pivot axis defined thereon. A first and a second vertical control follower are each pivotally connected to the vertical follower support at the vertical follower pivot axis. Each vertical control follower has a control portion and a cam engagement portion. The cam engagement portion has a cam engagement surface engaging a respective one of the offset vertical drive portions of the vertical cam portion such that as the vertical cam portion rotates about the respective cam axis, the offset vertical drive portions cause the vertical control followers to pivot back and forth about the vertical follower pivot axis thereby causing the control portions to oscillate back and forth. A first and a second mechanical vertical control coupling each couples a respective one of the foot support links to the control portion of a respective one of the vertical control followers such that as the vertical cam portion rotates about the respective cam axis, the mechanical vertical control couplings move the foot receiving areas of the foot support links in a path of travel having a vertical component of motion. A horizontal follower support is disposed on the frame, the horizontal follower support having a horizontal follower pivot axis defined thereon. A first and a second horizontal control follower are each pivotally connected to the horizontal follower support at the horizontal follower pivot axis. Each horizontal control follower has a control portion and a cam engagement portion. The cam engagement portion has a cam engagement surface engaging a respective one of the offset horizontal drive portions of the horizontal cam portion such that as the horizontal cam portion rotates about the respective cam axis, the offset horizontal drive portions cause the horizontal control followers to pivot back and forth about the horizontal follower pivot axis thereby causing the control portions to oscillate back and forth. A first and a second mechanical horizontal control coupling each couples a respective one of the guide links to the control portion of a respective one of the horizontal control followers such that as the horizontal cam portion rotates about the respective cam axis, the mechanical horizontal control couplings pivot the guide links about the first pivot axis, thereby moving the foot support areas of the foot support links in a path of travel having a horizontal component of motion. Movement of each foot receiving area in the path of travel having a vertical component of motion is generally out of phase with the movement in the path of travel having a horizontal component of motion such that when the horizontal component of motion of each foot receiving area is at its forwardmost or rearwardmost limit, the vertical component of motion of the same foot receiving area is approximately midway between its uppermost and lowermost limit. As such, the foot receiving area of each foot support link moves in a generally elliptical path when the cam portions rotate about the cam axes.

In some versions, the cam system is a single cam with the vertical control cam portion and the horizontal cam portion each forming part of the single cam and the cam axes are a common axis defined on the frame. In some alternatives, the first offset vertical drive portion and the first offset horizontal drive portion are generally coaxial and the second offset vertical drive portion and the second offset horizontal drive portion are generally coaxial.

In some versions, the vertical control followers are disposed generally perpendicular to the horizontal control followers.

In some versions, the vertical follower support is a movable support operable to move the vertical follower pivot axis relative to the respective cam axis so as to alter a range of travel of the control portion of the vertical control followers, thereby altering a range of the path of travel having a vertical component of motion. A vertical control actuator may move the movable vertical control follower support.

In certain versions, the vertical follower support is a vertical follower support link having a frame end pivotally connected to the frame and a follower end defining the vertical follower pivot axis, the vertical follower support link being pivotable about the frame end so as to move the vertical follower pivot axis relative to the respective cam axis. A vertical control actuator may pivot the vertical follower support link. In other versions, the vertical follower support is linearly displaceable on the frame.

In some versions, the horizontal follower support is a movable support operable to move the horizontal follower pivot axis relative to the respective cam axis so as to alter a range of travel of the control portion of the horizontal control followers, thereby altering a range of the path of travel having a horizontal component of motion. A horizontal control actuator may move the movable horizontal control follower support.

In certain versions, a follower support rocker is pivotally interconnected with the frame. The rocker has a first arm defining the vertical follower support, an outer end of the first arm defining the vertical follower pivot axis. The rocker also has a second arm defining the horizontal follower support, an outer end of the second arm defining the horizontal follower pivot axis. A control actuator pivots the rocker about the rocker pivot thereby moving the vertical and horizontal pivot axes relative to the respective cam axes.

In some versions, the followers are curved.

In certain versions, the first and second mechanical vertical control couplings are flexible couplings each having one end coupled to the control portion of the respective vertical control follower and an opposite end coupled to the respective foot support link. Each flexible coupling has a midportion extending over a guide disposed on the frame rearward of the first pivot axis. The vertical control followers may have a lower end pivoted to the frame and an upper end defining the control portion. The one end of each flexible coupling is coupled to the upper end of the respective vertical control follower and extends generally rearwardly to the guide on the frame.

In certain alternatives, each of the guide links has a guide length defined between the first and second attachment point and each of the flexible couplings has a foot support portion extending between a coupling point on the respective foot support link and the guide on the frame. The foot support portion is generally parallel to the respective guide link throughout the motion of the device and the foot support portion has a length that is similar to the guide length when the respective foot support link is at a midpoint of vertical travel. The respective first attachment point, second attachment point, guide on the frame and coupling point on the foot support portion generally define a parallelogram when the respective foot support link is at the midpoint of vertical travel.

In some versions, the first and second mechanical vertical control couplings are vertical control links each having one end connected to the control portion of a respective one of the vertical control followers and a second end connected to a respective one of the foot support links forward of the second attachment point.

The vertical control followers may be elongated elements. In one version, each has one end pivotally connected to the vertical follower support, an opposite end defining the control portion, and a midportion defining the cam engagement portion. In a second version, each has one end pivotally connected to the vertical follower support, an opposite end defining the cam engagement portion, and a midportion defining the control portion. In a third version, each has one end defining the cam engagement portion, an opposite end defining the control portion, and a midportion pivotally connected to the vertical follower support.

In some versions, each of the guide links further includes a hand portion extending upwardly from the first attachment point.

In certain versions, the device has an adjustable resistance element coupled to the cam system.

DETAILED DESCRIPTION OF THE PREFERRED EMBODIMENTS

Figure 1A:
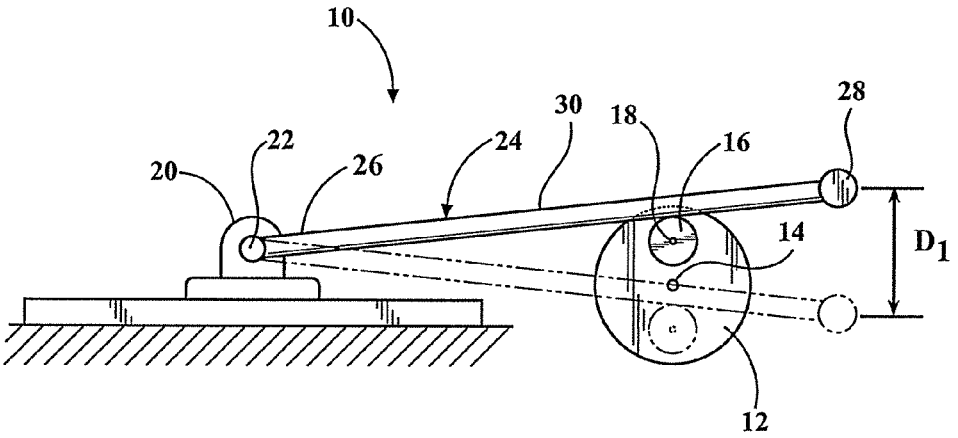
FIG. 1A is a schematic showing a cam and follower arrangement for use with some embodiments of the present invention.

The present invention will be explained with reference to several particular embodiments, including variations and optional features of these embodiments. It is to be understood that yet other embodiments, modifications, and variations thereof will be apparent to those of skill in the art in view of the teaching presented herein. Further, features and elements of certain embodiments may be combined with each other in combinations other than those illustrated and variations and optional features may be used with any of the embodiments.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Embodiments of the present invention make use of a cam and follower arrangement to control horizontal and/or vertical motion of the foot receiving areas of the exercise device. A "cam" is defined herein as an element that rotates about a cam axis and has one or more portions that are offset from the cam axis. As such, as the cam rotates about the cam axis, a follower contacting the offset portion at a particular radial position would be moved inwardly and outwardly relative to the cam axis. Such an offset portion may take the form of a cam lobe or an eccentric disk such as a round shaft with a central axis that is offset from the cam axis. In the present invention, a follower is typically a pivoting elongated element with a portion that contacts the offset portion of the cam. The cam follower is pivotally attached to a follower support and has a cam engagement portion spaced from the pivot that contacts the offset portion of the cam. The follower further has a control portion that is caused to oscillate back and forth as the cam rotates about the cam axis. A cam may be referred to herein as a cam system, with the cam system consisting of one or more cams each with one or more offset portions. Embodiments of the present invention couple the control portion of followers to elements that cause horizontal or vertical motion of the foot receiving areas such that as the cam or cam system rotates, the control portions of the followers oscillate back and forth causing reciprocal horizontal and/or vertical motion of the foot receiving areas.

Referring now to FIG. 1A, a generic cam and follower arrangement will be discussed. The cam and follower arrangement 10 includes a cam 12 that is rotatable about a cam axis 14. In FIG. 1A, the cam 12 has an offset portion 16 in the form of a round shaft with a central axis 18 offset from the cam axis 14. The cam 12 is illustrated with the offset portion 16 at a 12:00 position and also illustrated with the offset portion at a 6:00 position shown in phantom lines. As will be clear to those of skill in the art, the offset portion 16 rotates about the cam axis 14 as the cam 12 rotates. A follower support 20 is spaced from the cam 12 and has a follower pivot axis 22 defined thereon. A follower 24 has a pivot end 26 pivotally attached to the follower pivot axis 22 and an opposite control end or portion 28. A mid portion 30 of the follower 24 extends between the ends 26 and 28 and defines a cam engagement portion with a cam engagement surface in contact with the outer surface of the offset portion 16 of the cam 12. The follower 24 is shown in solid lines in contact with the offset portion 16 in the 12:00 position and in phantom lines in contact with the offset portion 16 in the 6:00 position. As is clear from the figure, as the cam 12 rotates about the cam axis 14, the control end 28 of the follower 24 will oscillate up and down and travel along a distance labeled as D1.

Figure 1B:
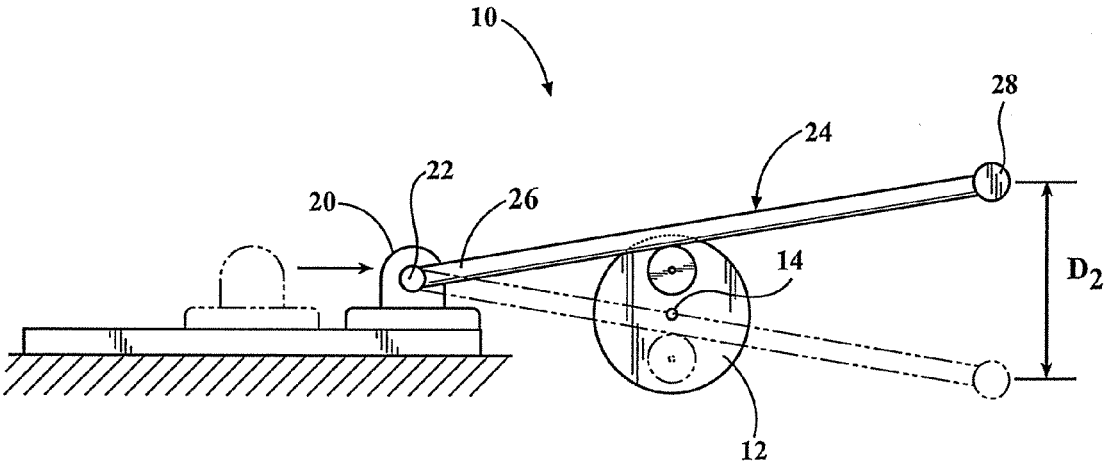
FIG. 1B is a schematic similar to FIG. 1A in which the support for the follower is moved closer to the cam in order to alter the range of travel of a control portion of the follower.

In certain embodiments of the present invention, horizontal and/or vertical motion is adjustable by adjusting the relative distance between the follower pivot axis and the cam. The cam and follower arrangement 10 is shown in FIG. 1B with the follower support 20 moved closer to the cam 12. As shown, this reduces the distance between the follower pivot axis 22 and the cam axis 14. Because the cam 12 is now closer to the pivot end 26 of the follower 24 the control end 28 is caused to travel or oscillate through a distance labeled as D2 which is greater than D1.

Figure 2A:
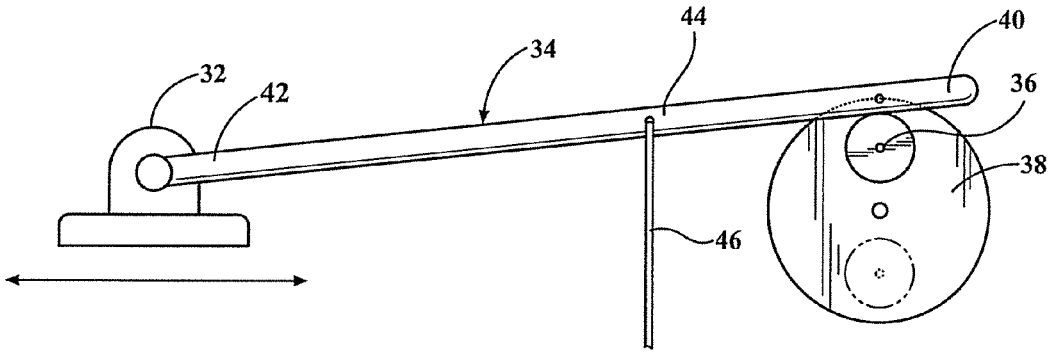
FIG. 2A is a schematic of an alternative cam and follower arrangement.

As will be clear to those of skill in the art, a cam follower arrangement may take a variety of forms. FIG. 2A illustrates an alternative in which a follower support 32 is pivotally attached to one end of a follower 34 while the offset portion 36 of a cam 38 engages an engagement portion 40 of the follower that is at an end opposite the pivot end 42. In this arrangement, the control portion 44 is a mid portion of the follower 34. Some type of control element or coupling 46 may be attached to the control portion 44 of the follower 34.

Figure 2B:
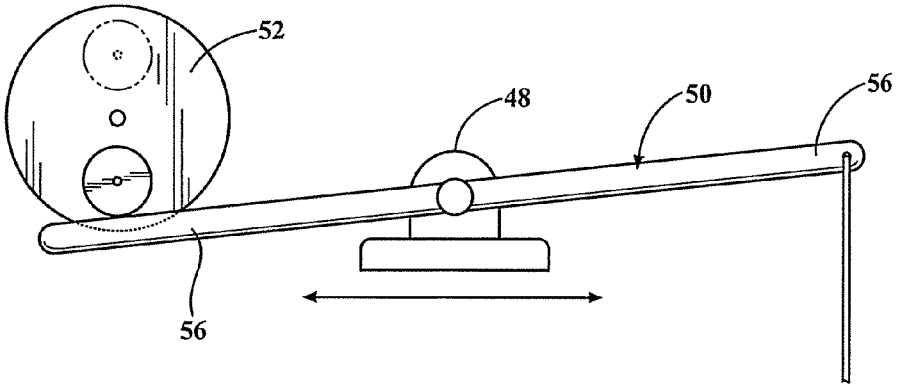
FIG. 2B is a schematic of a further alternative cam and follower arrangement.

FIG. 2B illustrates a further alternative arrangement in which the follower support 48 is pivotally attached to a mid portion of the follower 50, a cam 52 engaging one of the ends 54 of the follower 50, and the other end 56 defining the control portion. In each of these arrangements, the distance between the pivot axis on the follower support and the cam may be adjusted so as to adjust the amount of travel of the control portion of the follower. Certain embodiments of the present invention are illustrated with one type of cam and follower arrangement. Those of skill in the art will recognize that other arrangements may be substituted.

Figure 3:
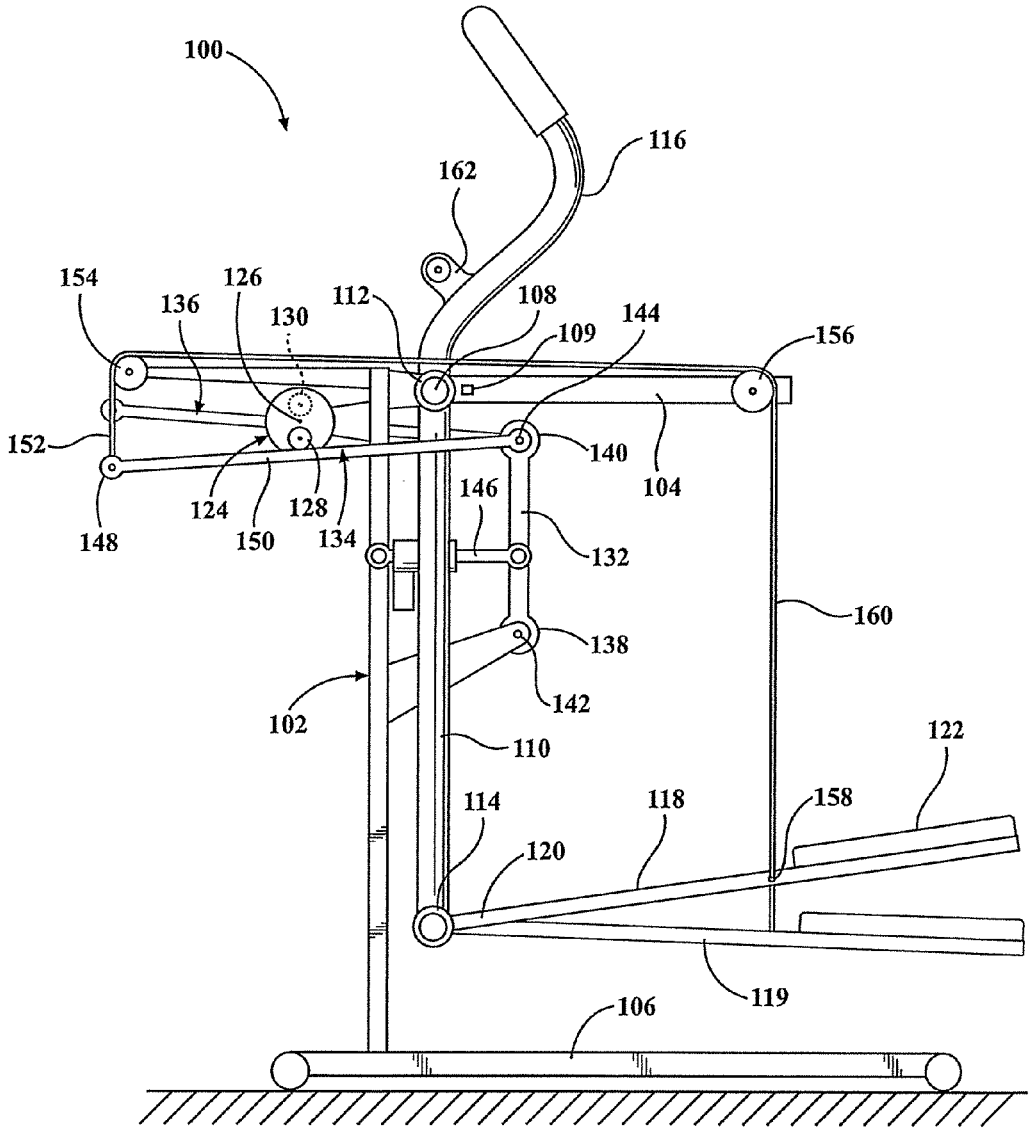
FIG. 3 is a side view of a first embodiment of an exercise device in accordance with the present invention.

Referring now to FIG. 3, a first embodiment of an exercise device in accordance with the present invention is shown generally at 100. The illustrated device is a free stride type device in which the extent of horizontal motion is controlled by the user. However, the device 100 may be modified to include a horizontal control system from one of the other embodiments in order to convert the device into a fixed path device. The illustrated device 100 includes a frame 102 which is configured and operative to retain and support the various other components of the device on a horizontal surface such as a floor. The frame 102 is typically fabricated from metal and/or composite materials, but any material may be used. The frame 102 has an upper portion 104 and a lower portion 106. The lower portion 106 is configured to contact the horizontal surface while the upper portion 104 supports several components of the device. A first pivot axis 108 is defined in a middle area of the upper portion 104 of the frame 102. The frame 102 may be said to have a forward portion forward of the first pivot axis 108, which is to the left in the view of FIG. 3, and a rearward portion rearward of the first pivot axis 108, which is to the right in the view of FIG. 3. As will be clear to those of skill in the art, exercise devices such as those described herein include left and right elements for supporting the respective left and right feet of the user. The right and left components of the device are typically substantially the same, though the machine may be constructed such that the two foot receiving areas are 180 degrees out of phase. That is, when one foot receiving area is moving forwardly and/or downwardly, the other foot receiving area is moving rearwardly and/or upwardly. The embodiments of the present invention will be described primarily with reference to only one set of components, with it being understood that the corresponding components of the other half of the device are constructed similarly. FIG. 3 shows a side view of the device 100 with the left elements most visible.

A pair of guide links are pivotally interconnected with the frame so as to be pivotal about the first pivot axis 108. The left guide link 110 is shown at the midpoint of its travel with the right guide link hidden behind it. All left and right components may alternatively be referred to as first and second components for ease of description. The guide link 110 may be said to have a first attachment point 112 towards its upper end and a second attachment point 114 at its lower end. The guide link 110 is pivotally interconnected with the first pivot axis 108 of the frame 102 at its first attachment point 112. In the illustrated embodiment, the guide link 110 further includes a hand portion 116 that extends upwardly from a first attachment point 112. Each guide link 110 has a corresponding foot support link 118 pivotally connected thereto. In the illustrated embodiment, the foot support link 118 has a forward end 120 that is pivotally interconnected with the second attachment point 114 of the guide link 110. The foot support link 118 further has a foot receiving area 122 defined at its rearward end. A cam system 124 is pivotally interconnected with the frame 102 such that a cam system 124 rotates about a second pivot axis 126 defined on the frame 102. The second pivot axis 126 also serves as the cam axis. In this embodiment, the cam system 124 is at the upper portion 104 of the frame 102 and forward of the first pivot axis 108. The second pivot axis 126 is below the first pivot axis 108. The cam system 124 is similar to the cam system illustrated in FIGS. 1A and 1B, having an offset portion 128 for controlling vertical motion of the left foot support link 118. The offset portion 128 is shown at a 6:00, or downward, position. An alternative position with the crank system 124 rotated 180 degrees is shown in phantom lines at 130. This offset portion 130 may alternatively represent the offset portion for controlling the vertical motion of the right foot support link. A follower support is shown at 132. The follower support 132 is referred to as a vertical follower support because it supports followers 134 and 136 that are responsible for vertical motion of the foot support links.

In this embodiment, the follower support takes the form of a follower support link 132 having a frame end 138 pivotally connected to the frame 102 and a follower end 140 defining the vertical follower pivot axis 144. The frame 102 may be said to have a third pivot axis 142 to which the vertical follower support link 132 is pivotally attached. By pivoting the vertical follower support link 132 about the axis 142, the follower end 140 and associated vertical follower pivot axis 144 is moved closer to or further from the cam axis 126. An actuator 146 may be provided for pivoting the vertical follower support link 132 about the axis 142. In the illustrated embodiment, both the left vertical control follower 134 and right vertical control follower 136 are pivoted to the follower end 140 of the vertical follower support link 132. Alternatively, separate links may be used.

The left vertical control follower 134 has a control portion 148 that moves upwardly and downwardly as the cam system 124 rotates about the cam axis 126. A mid portion 150 of the follower 134 acts as a cam engagement portion with a surface that presses against the offset portion 128 of the cam system 124. A mechanical vertical control coupling 152 couples the control portion 148 of the follower 134 to the respective foot support link 118 such that rotation of the cam system 124 causes the foot receiving area 122 of the foot support link 118 to move upwardly and downwardly, which is a path of travel having a vertical component of motion. The mechanical vertical control coupling may take a variety of forms. In the illustrated embodiment, the control coupling 152 is a flexible element such as a cable or strap having one end connected to the control portion 148 of the follower 134, an opposite end connected to a mid portion of the foot support link 118, forward of the foot receiving area 122, and a mid portion that passes over a pair of guide pulleys on the frame 102. A forward guide pulley 154 is disposed on the upper portion 104 of the frame 102 forward of the first pivot axis 108 and generally directly above the control portion 148 of the follower 134. A rear guide pulley 156 is disposed on the upper portion 104 of the frame 102 rearward of the first pivot axis 108 and generally directly above the coupling point 158 where the flexible element is connected to the foot support link 118.

The illustrated configuration provides a parallelogram-type configuration. The flexible coupling 152 may be said to have a foot support portion 160 extending between the coupling point 158 and the rear guide pulley 156. This foot support portion 160 is generally parallel to the respective guide link 110 at all times. Further, the guide link 110 may be said to have a guide length defined between the first attachment point 112 and second attachment point 114. The length of the foot support portion 160 of the flexible coupling 152 varies with the position of the foot support link 118. In FIG. 3, the foot support link 118 is shown in an upper position. The right foot support link 119 is shown in the downward position. As will be clear from the figure, the length of the foot support portion 160 of the flexible coupling 152 when the foot support link is at a midpoint of its vertical travel is similar to or generally the same as the guide length of the guide link 110. As such, the first attachment point 112, second attachment point 114, rear guide pulley 156, and coupling point 158 generally define a parallelogram when the foot support link 118 is at a midpoint of its vertical travel. This parallelogram-type configuration provides a desirable motion profile.

As mentioned previously, the illustrated embodiment of the exercise device 100 is a free stride type device. This means that horizontal travel of the foot support portions depends on how much fore-aft force is applied to the foot receiving areas or hand portions by the user. Horizontal travel occurs as the guide links 110 pivot about the first pivot axis 108. Alternatively, the exercise device 100 may be a fixed path device by providing a drive mechanism for horizontal motion. The guide links 110 are shown having an attachment portion 162 extending forwardly from the remainder of the guide link. A horizontal drive apparatus may be attached to the attachment portion 162 for providing pivoting motion of the guide links and therefore movement of the foot receiving areas 122 in a path of travel having a horizontal component of motion.

As will be clear from the earlier discussion of FIGS. 1A and 1B, the range of vertical motion of the foot receiving areas 122 may be altered by vertical follower support link 132 so as to move the pivot 144 closer to or further from the cam axis 126. As the link 132 pivots counterclockwise, the follower support pivot 144 moves closer to the cam axis 126 causing increased travel of the control portions 148 of the followers and thereby increased travel of the flexible coupling 152 and associated foot support link 118. One or more sensors may be provided on the exercise device, such as pivot sensor 109, to sense the amount of horizontal travel and/or the position of the guide links. This allows several options. The amount of vertical travel may be increased or decreased depending on the length of the horizontal stride. For example, the vertical travel may be decreased as horizontal stride length increases. The position of the guide links and/or the rate at which they pivot may be used to determine the cam position or rate of rotation in order to maintain a desired coordination between horizontal and vertical travel.

Figure 4:
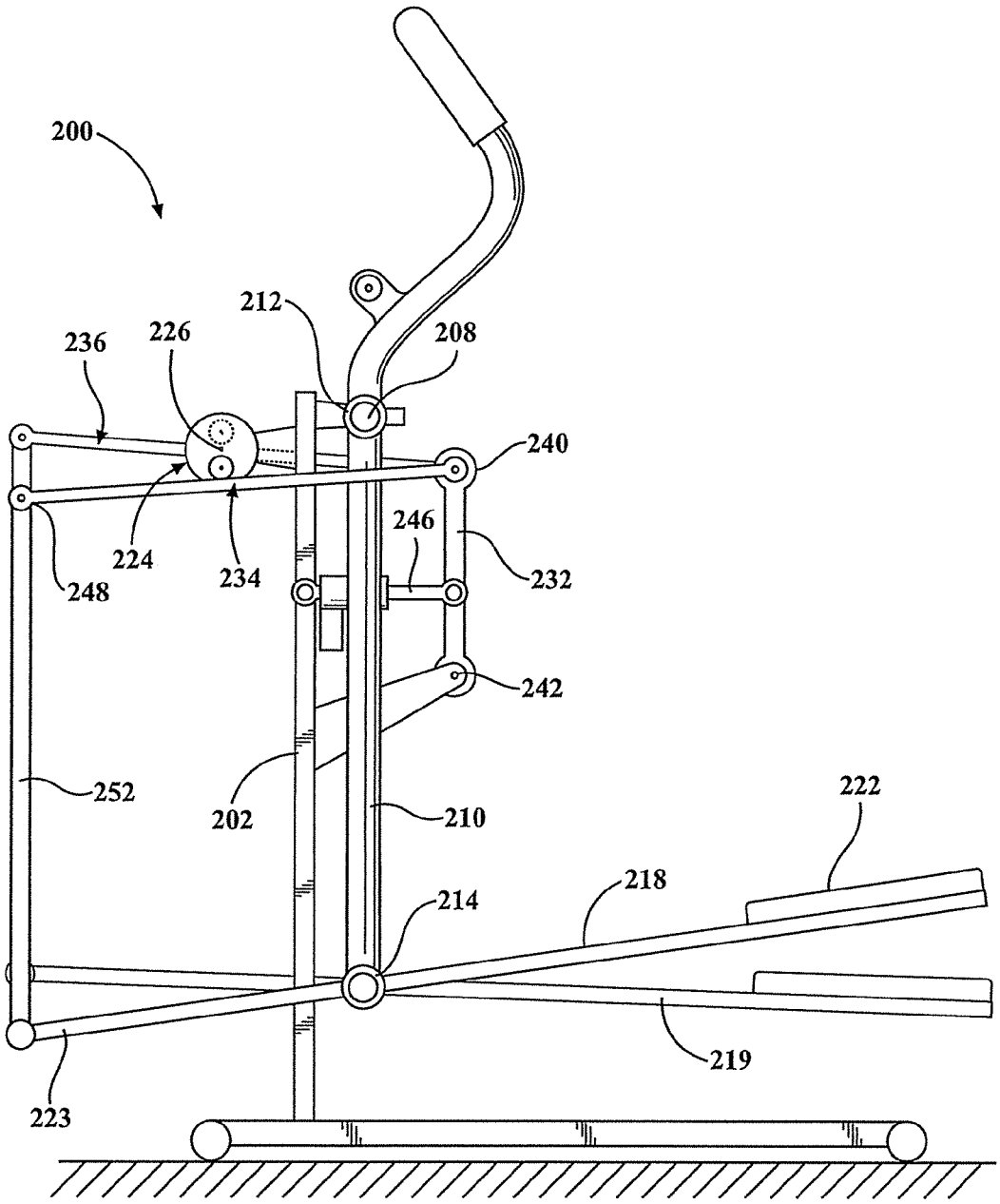
FIG. 4 is a side view of a second embodiment of an exercise device in accordance with the present invention.

Referring now to FIG. 4, a second embodiment of an exercise device in accordance with the present invention is shown generally at 200. Much of the structure is similar to the first embodiment, including a frame 202 having a first pivot axis 208 and a guide link 210 connected to the first pivot axis at its first attachment point 212. A first foot support link 218 is connected to a second attachment point 114 of the guide link 210. Unlike the first embodiment, the foot support link 218 is pivotally connected to the second attachment point 214 at a mid portion of the link 218 with a rearward end of the link 218 defining the foot receiving area 222 and a forward end 223 coupled to the cam and follower system. The cam and follower system is similar to the first embodiment, including a cam system 224 pivotally attached to a second pivot axis on the frame at a cam axis 226. A vertical follower support link 232 is pivoted to the frame at 242 and vertical control followers 234 and 236 are pivotally attached to the upper follower end 240 of the vertical follower support link 232. In this embodiment, the mechanical vertical control couplings take the form of vertical control links 252. An upper end of the vertical control link 252 is pivotally attached to the control portion 248 of the follower 234 and the lower end of the vertical control link 252 is pivotally connected to the forward end 223 of the foot support link 218. As will be clear from the figure, rotation of the cam system 224 about the cam axis 226 causes the control portion 248 of the follower 234 to oscillate upwardly and downwardly, thereby causing the foot receiving area 222 to oscillate upwardly and downwardly, along a path of travel having a vertical component of motion. Again, the amount of vertical travel may be adjusted by adjusting the position of the vertical follower support link 232, such as by using actuator 246. As with the first embodiment, the embodiment 200, as illustrated, is a free stride type exercise device, but may be configured as a fixed path device by providing a horizontal drive mechanism for pivoting the guide links with respect to the frame.

Figure 5:
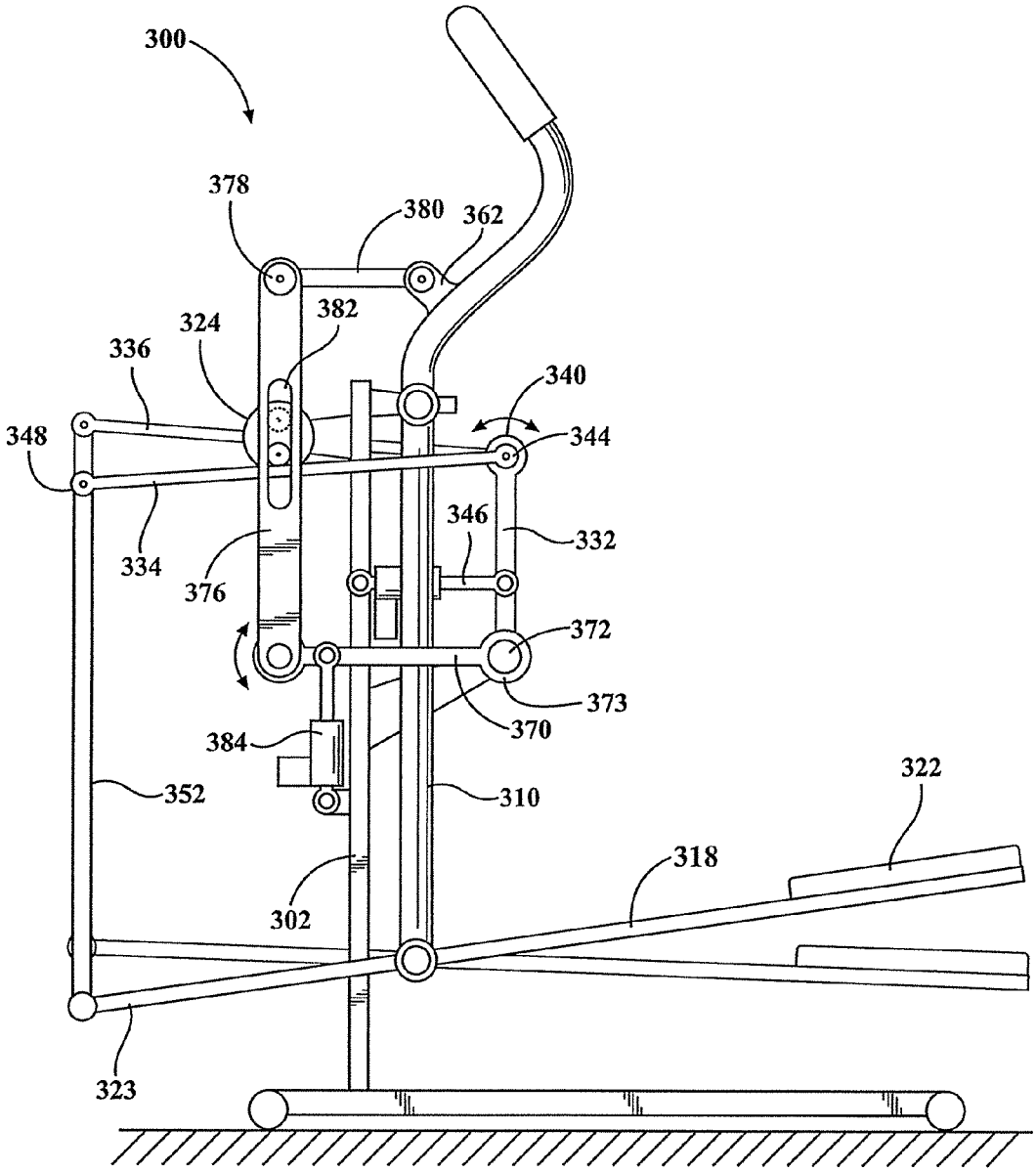
FIG. 5 is a side view of a third embodiment of an exercise device in accordance with the present invention.
Figure 6A:
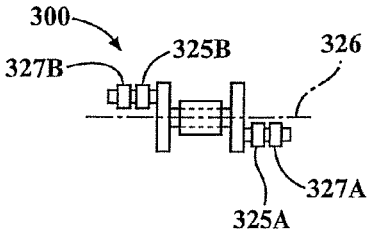
FIG. 6A is a view taken along line 6A-6A of FIG. 6, showing a construction of the cam.
Figure 6:
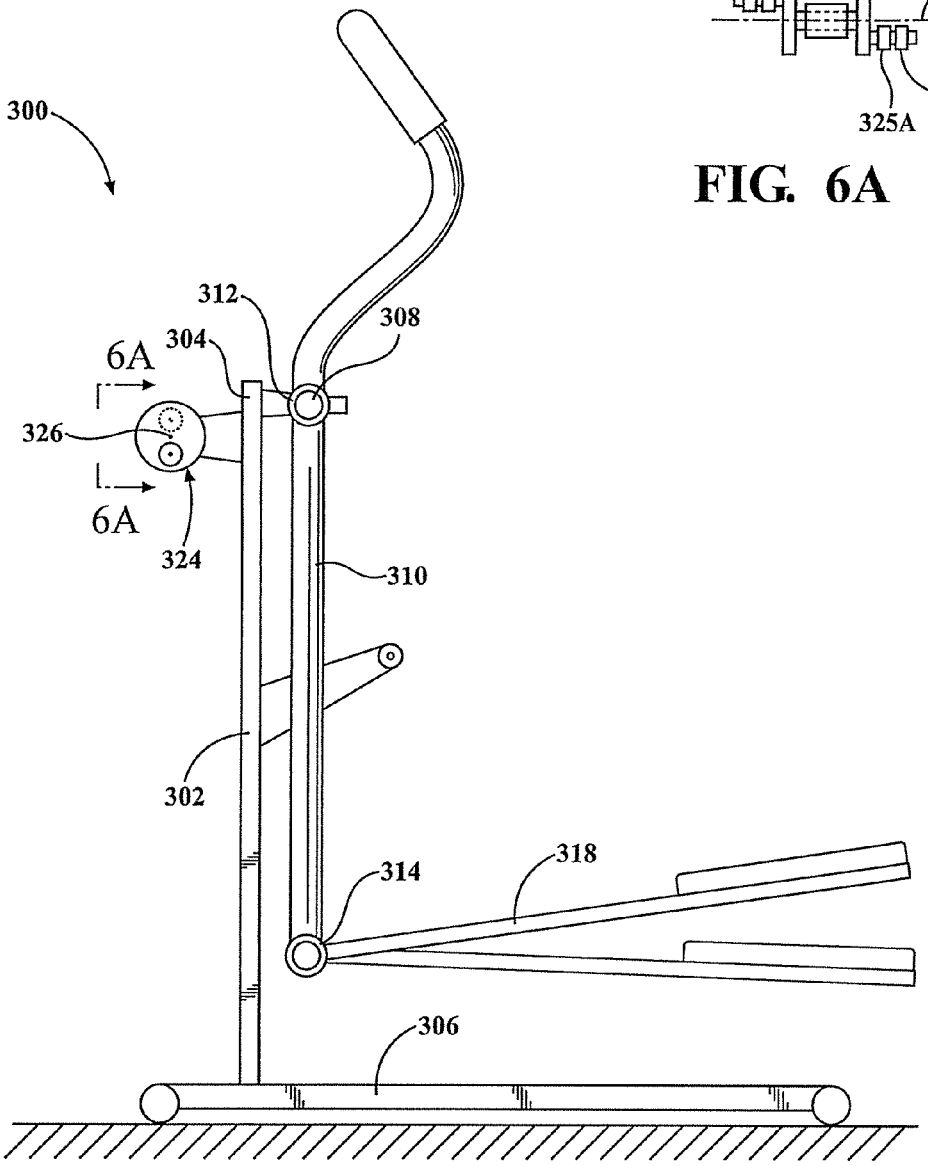
FIG. 6 is a side view of a portion of the exercise device of FIG. 5 with the horizontal and vertical linkage assemblies removed.
Figure 7:
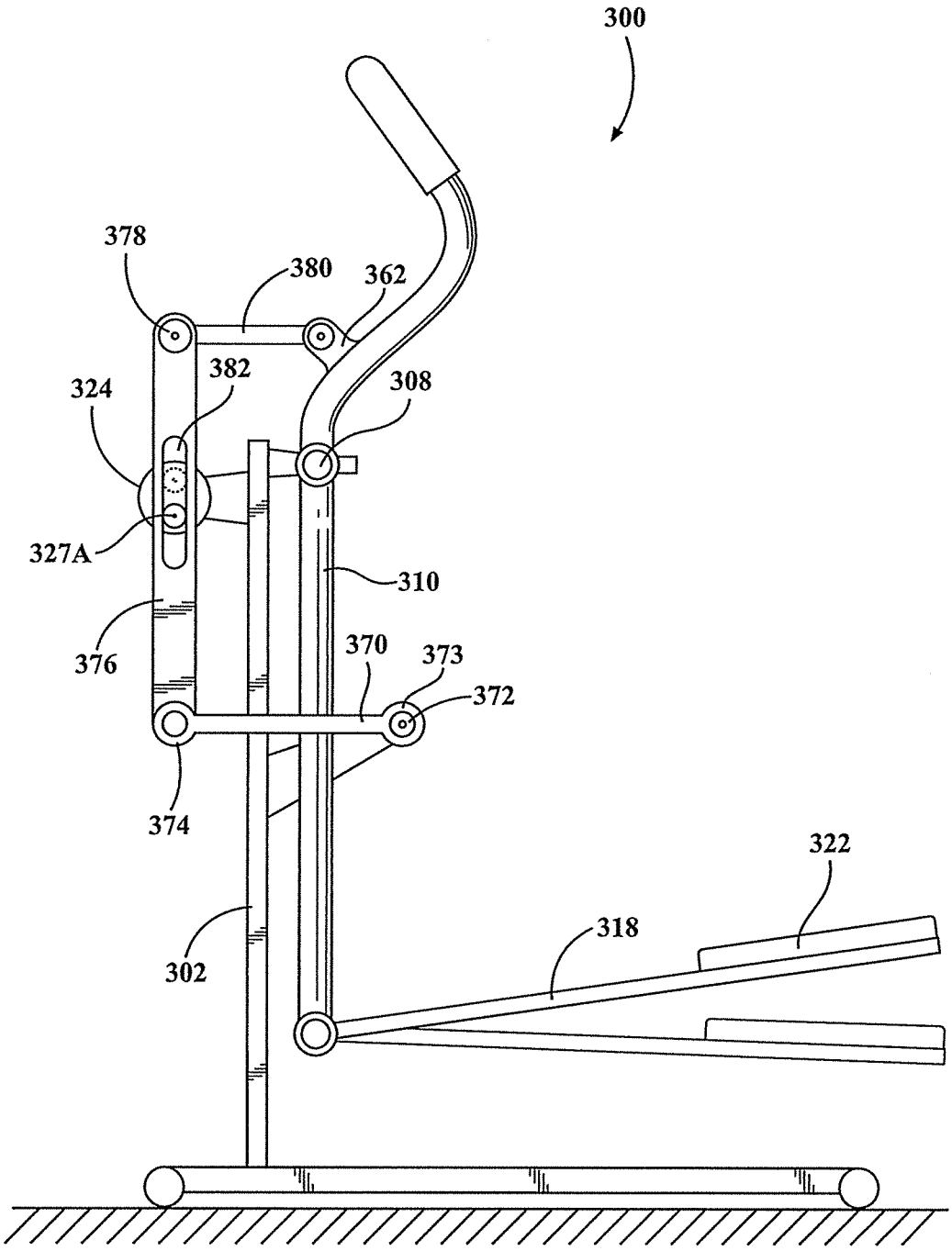
FIG. 7 is a side view of a portion of the exercise device of FIG. 5, showing only the horizontal control portion.

Referring now to FIGS. 5-7, a third embodiment of an exercise device in accordance with the present invention will be discussed. FIG. 3 shows a complete exercise device 300 with a cam and follower arrangement controlling both horizontal and vertical motion of the foot receiving areas. FIG. 6 provides a view of just a portion of the exercise device 300, with the horizontal and vertical control portions removed for ease of description. FIG. 7 is a view similar to FIG. 6 but with the horizontal follower support link and horizontal follower included. Beginning with FIG. 6, the exercise device 300 includes a frame 302 with an upper portion 304 for supporting components of the exercise device and a lower portion 306 for contacting the horizontal support surface. A first pivot axis 308 is defined on the upper portion 304 of the frame 302. A guide link 310 is pivotally attached to the first pivot axis 308 at a first attachment point 312 and a foot support link 318 is pivotally attached to a second attachment point 314 on the guide link 310. A cam system 324 is pivotally attached to the upper portion 304 of the frame 302 at a second pivot axis 326, also defining a cam axis.

The cam system 324 is shown in more detail in FIG. 6A. In this embodiment, the cam system comprises a single cam. The cam 324 has a portion that may be referred to as a horizontal control cam portion for controlling horizontal motion of the foot receiving areas and a portion that may be referred to as a vertical control cam portion for controlling the vertical motion of the foot receiving areas. In this embodiment, the vertical control cam portion includes the inner offset drive portions 325*a* and 325*b* and the horizontal control cam portion includes the outer offset drive portions 327*a* and 327*b*. As shown, these offset portions may be circular with a central axis that is offset from the cam axis 326. In some embodiments, the control cam portions may take the form of a roller bearing or other type of surface. As shown, the vertical control cam portion 325*a* for the left half of the machine and the horizontal control cam portion 327*a* for the left side of the machine share a common axis. Likewise, the vertical control cam portion 325*b* for the right half of the machine and the horizontal control cam portion 327*b* for the right half of the machine share a common axis. The portions 325*a* and 327*a* are offset 180 degrees from the portions 325*b* and 327*b*, thereby placing the right and left halves of the machine 180 degrees out of phase with one another.

Referring now to FIG. 7, a portion of the exercise device 300 is shown with the horizontal control portions included. A horizontal follower support link 370 has a frame end 373 pivoted to the frame 302 at a pivot axis 372. The axis 372 is rearward and below the first pivot axis 308. The horizontal follower support link 370 has an opposite follower end 374 to which a lower end of a horizontal control follower 376 is pivotally attached. The horizontal control follower 376 has an upper end 378 that serves as a control portion and is pivotally interconnected with an attachment portion 362 of the guide link 310 by a horizontal control link 380. A mid portion of the horizontal control follower, serving as a cam engagement portion, has a slot 382 defined therein. The left offset drive portion 327*a* of the cam system 324 is received in the slot 382 such that as the cam 324 rotates about the cam axis, the control portion 378 of the horizontal control follower 376 is moved fore and aft, thereby causing the guide link 310 to pivot about the first pivot axis 312, causing the foot receiving areas to move in a path of travel having a horizontal component of motion. The horizontal control follower 376 in this embodiment uses the slot 382 as a cam engagement portion so that the horizontal control follower can both push and pull on the guide link 310. As will be clear to those of skill in the art, the cam engagement surface in this embodiment will be both sides of the slot 382, since the offset portion engages both sides of the slot. In an alternative approach, the follower may have a side surface that contacts the offset portion, instead of the slot, and a biasing member such as a spring can keep the follower in contact with the offset portion. Other approaches may also be used for causing the follower motion to be controlled by the offset portion.

Referring now to FIG. 5, a more complete illustration of the exercise device 300 is provided, including both vertical and horizontal control. As shown, an actuator 384 may be provided for controlling the position of the horizontal follower support link 370, thereby controlling the range of horizontal travel.

A vertical follower support link 332 is also pivotally attached to the pivot axis 372 on the frame 302 and extends upwardly to a follower end 340 to which vertical control followers 334 and 336 are pivotally attached at axis 344. An actuator 346 controls the position of the vertical follower support link 332. The vertical control system is structured similar to the embodiment of FIG. 4, with the mid portion of the follower 334 serving as a cam engagement portion and engaging the offset vertical control portion 325*a* of the cam 324. The follower 334 has a forward end 348 that acts as a control portion and is linked to a forward end 323 of the foot support link 318 by vertical control link 352. In the illustrated embodiment, the horizontal follower support link 370 and the vertical follower support link 332 are separately pivotable such that the range of horizontal and vertical motion may be individually adjusted. Alternatively, the follower support 370 and the follower support 332 may be part of a single structure such that they pivot together such that one actuator may adjust both follower supports. Alternatively, the two follower supports may be interconnected by a linkage or gear mechanism to allow coordinated adjustment.

It is noted that in this embodiment the horizontal control followers and vertical control followers are disposed generally perpendicular to each other, with the vertical control followers extending generally horizontally between their pivot ends and control portions and the horizontal control followers extending generally vertically between their pivot ends and control portions. The horizontal follower support link and vertical follower support link are also generally perpendicular to each other, with the horizontal follower support link extending generally horizontally and the vertical follower support link extending generally vertically. The followers extend generally perpendicularly from their respective follower support links. This overall arrangement allows the use of a single cam wherein the left offset portions 325A and 327A of the vertical and horizontal control cam portions share a common axis and the right offset portions 325B and 327B also share a common axis. In an alternative approach, the vertical and horizontal control followers may be more parallel to each other, necessitating a cam system with horizontal and vertical drive portions offset from one another.

Figure 8:
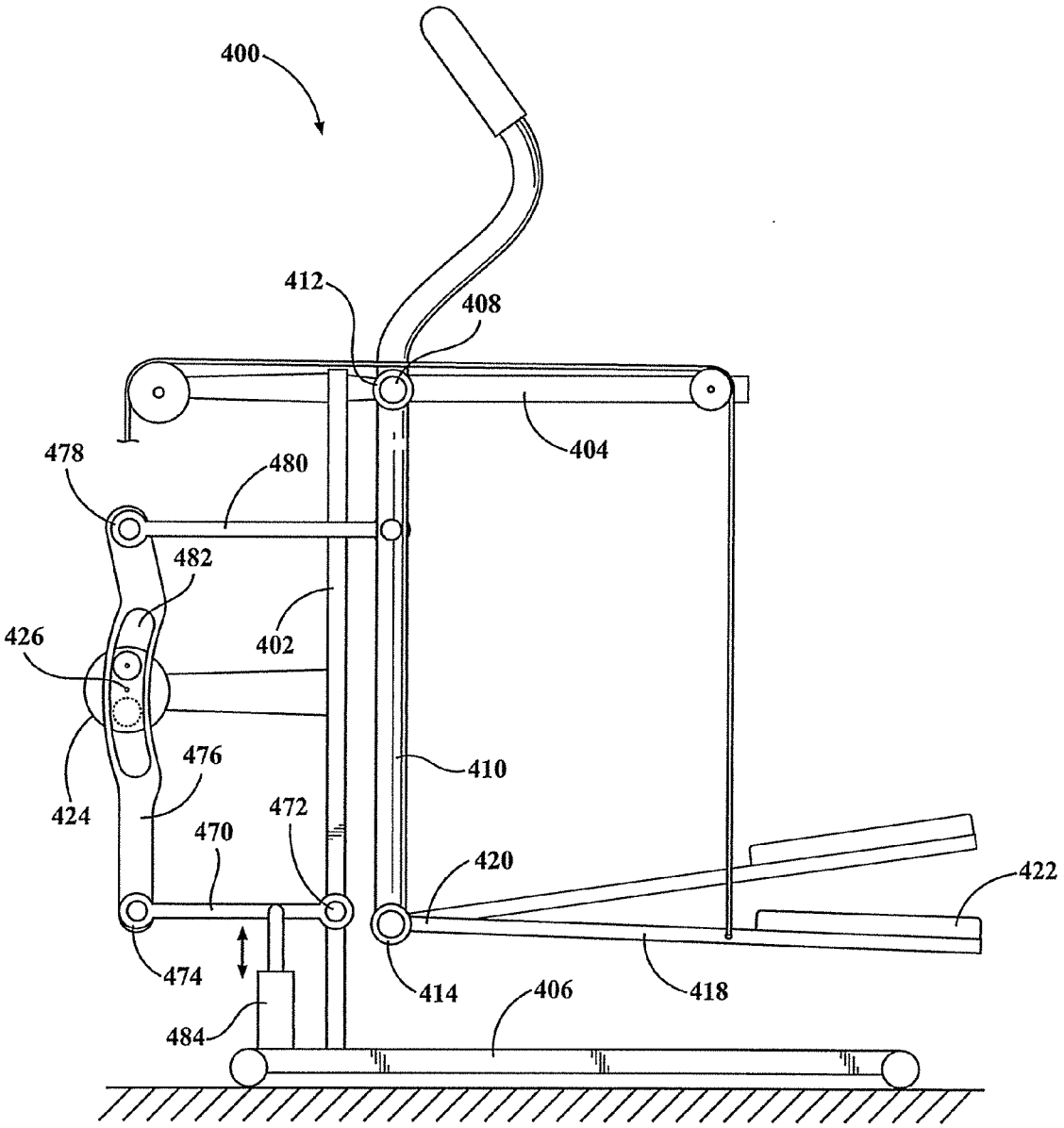
FIG. 8 is a side view of a fourth embodiment of an exercise device in accordance with the present invention.
Figure 9A:
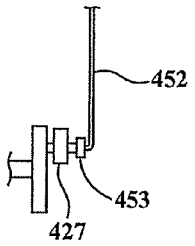
FIG. 9A is a view taken along lines 9A-9A of FIG. 9 showing the horizontal cam portion and vertical drive.
Figure 9:
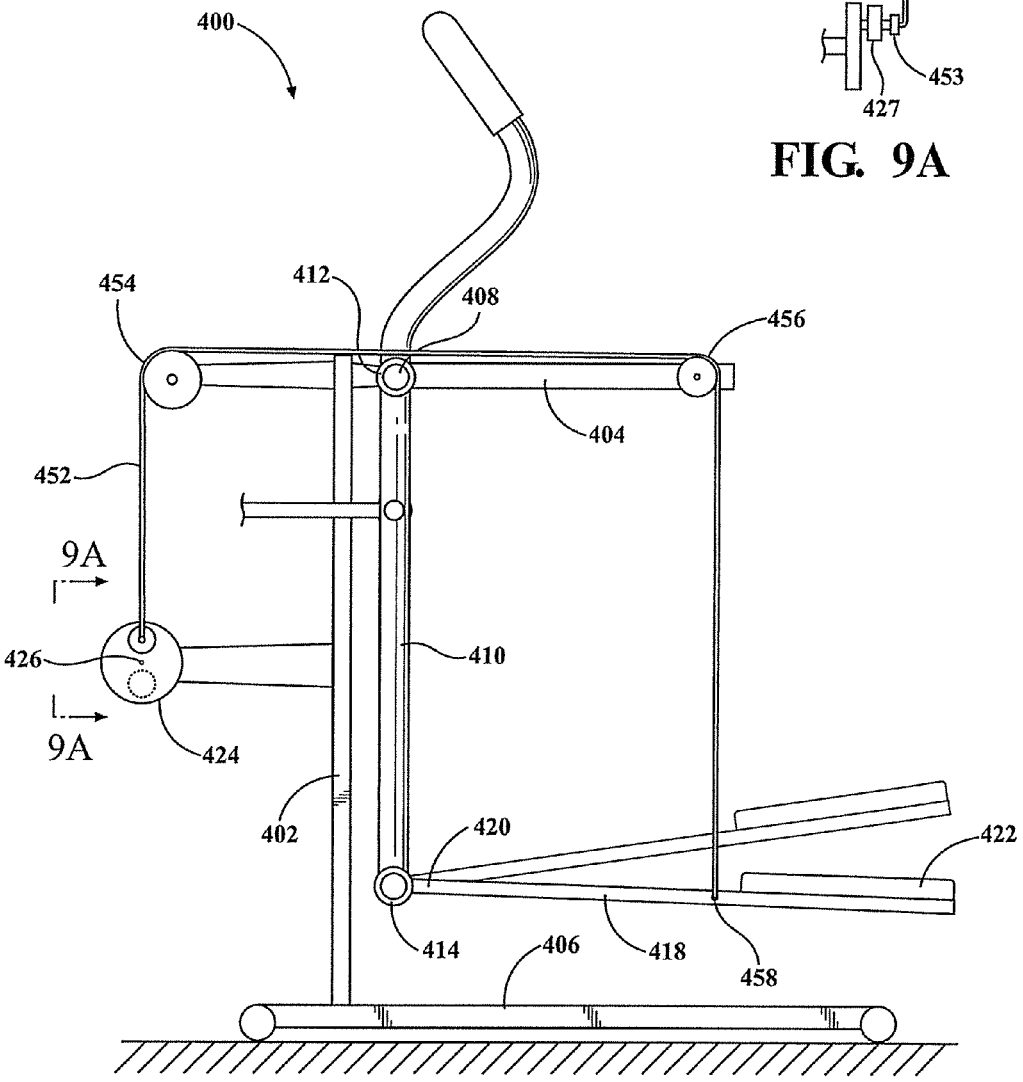
FIG. 9 is a side view of the exercise device of FIG. 8 showing the vertical drive system.

FIGS. 8 and 9 illustrate a fourth embodiment of an exercise device in accordance with the present invention. FIG. 8 illustrates the horizontal control portions and FIG. 9 illustrates the vertical control portions. As with earlier embodiments, the device 400 includes a frame 402 with an upper portion 404, a lower portion 406, and a first pivot axis 408 defined on the upper portion. Left guide link 410 is pivotally attached to the axis 408 at a first attachment point 412 and a foot support link 418 has a forward end 420 attached to a second attachment point 414 on the guide link 410. A foot receiving area 422 is defined at the rearward end of the foot support link 418. A cam system 424 is pivotally attached to the frame 402 at a second pivot axis 426, also defining the cam axis. The cam axis 426 is below and forward of the first pivot axis 408. A horizontal follower support link 470 is pivotally attached to the frame at pivot axis 472. A horizontal control follower 476 is pivotally supported to a follower end 474 of the follower support link 470 and has a cam engagement slot 482 engaging the offset horizontal drive portion of the horizontal control cam portion of the cam system 424. A control portion 478 of the horizontal control follower 476 is linked to the guide link 410 by a horizontal control link 480. An actuator 484 may be used to adjust the position of the horizontal follower support link 470 so as to adjust the range of horizontal travel.

Referring to FIG. 9, the vertical control system will be described. The exercise device 400 differs from earlier embodiments in that a cam and follower arrangement is not used to control the vertical travel of the foot receiving areas 422. Instead, a flexible element 452 has one end connected to a portion of the cam system 424 that serves as a crank, an opposite end coupled to the foot support link 418 at coupling point 458, and a mid portion that passes over a forward guide pulley 454 and a rearward guide pulley 456. FIG. 9A shows a detail of part of the crank system 424 including the offset horizontal drive portion 427 and the attachment of the flexible coupling 452 that acts as a crank arm 453. As will be clear to those of skill in the art, as the cam system 424 rotates about the cam axis 426, the crank arm portion 453 pulls on the flexible coupling 452 causing oscillation of the foot support link 418. This arrangement for vertical control may be referred to as a vertical drive system that is mechanically coupled to the foot support links.

Figure 10:
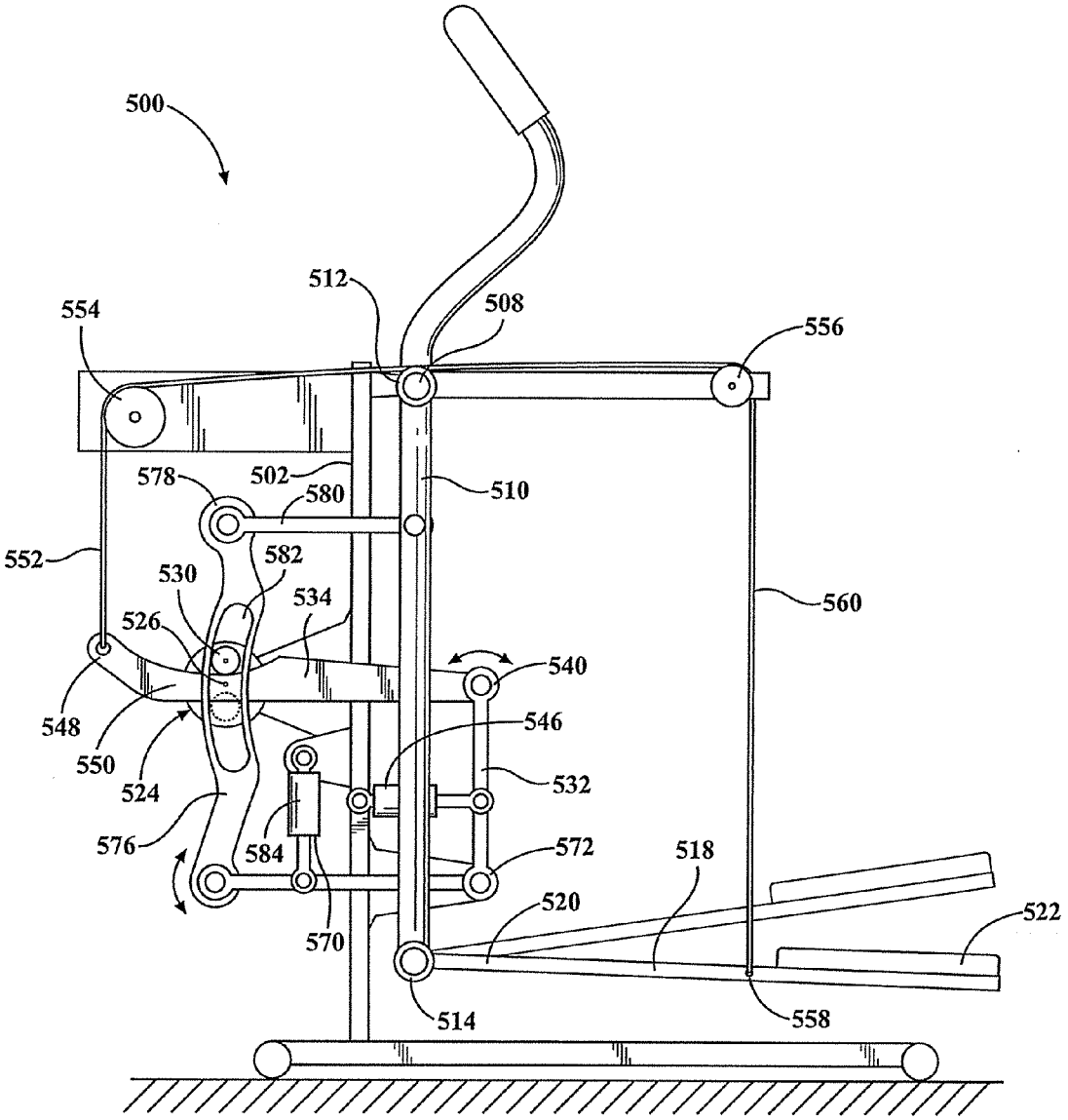
FIG. 10 is a side view of a fifth embodiment of an exercise device in accordance with the present invention.

Referring now to FIG. 10, a fifth embodiment of an exercise device in accordance with the present invention is shown generally at 500. As with earlier embodiments, the device 500 includes a frame 502 with a first pivot axis 508; a guide link 510 having a first attachment point 512 attached to the first pivot axis 508 and a second attachment point 514; and a foot support link 518 having a forward end 520 pivotally attached to the second attachment point 514 of the guide link 510 and a foot receiving area 522 at a rearward end of the foot support link 518. A vertical follower support link 532 and a horizontal follower support link 570 are both pivotally attached to a third pivot axis 572 of the frame 502, with the vertical follower support link extending upwardly and the horizontal follower support link 570 extending forwardly. A vertical control follower 534 is pivotally attached to a follower end 540 of the follower support link 532 and extends forwardly to a control portion 548. A mid portion 550 of the vertical control follower 534 serves as a cam engagement portion and engages the offset portion 530 of the cam system 524. A flexible element 552, serving as a mechanical vertical control coupling, has one end coupled to the control portion 548 of the follower 534 and a second end 558 coupled to a mid portion of the foot support link 518. A mid portion of the flexible element 552 passes over a forward guide pulley 554 and a rearward guide pulley 556. As discussed with respect to an earlier embodiment, this embodiment has a parallelogram-type arrangement of the foot support portion 560 of the flexible coupling 552 and the guide link 510.

A horizontal control follower 576 is pivotally attached to a follower end of the horizontal follower support link 570 and extends upwardly to a control portion 578. A mid portion of the follower 576 has a slot 582 defined therein that serves as an engagement portion for engaging the offset portion 530 of the cam system 524. A horizontal control link 580 couples the control portion 578 of the horizontal control follower 576 to the guide link 510. As will be clear from a review of the figures, as the cam system 524 rotates about the cam axis 526, the offset portion 530 acts as both a horizontal control portion and a vertical control portion of the cam system and causes both the followers 534 and 576 to oscillate such that the foot receiving area 522 is caused to travel along a generally elliptical path. The cam system may take a form similar to in FIG. 6A. The actuators 546 and 584 may be used to adjust the position of the vertical follower support link 532 and the horizontal follower support link 570, respectively, so as to adjust the range of vertical and horizontal travel. Alternatively, the vertical follower support link 532 and horizontal follower support link 570 may be interconnected as one element or interlinked in a variety of ways so as to allow coordinated adjustment.

Figure 11:
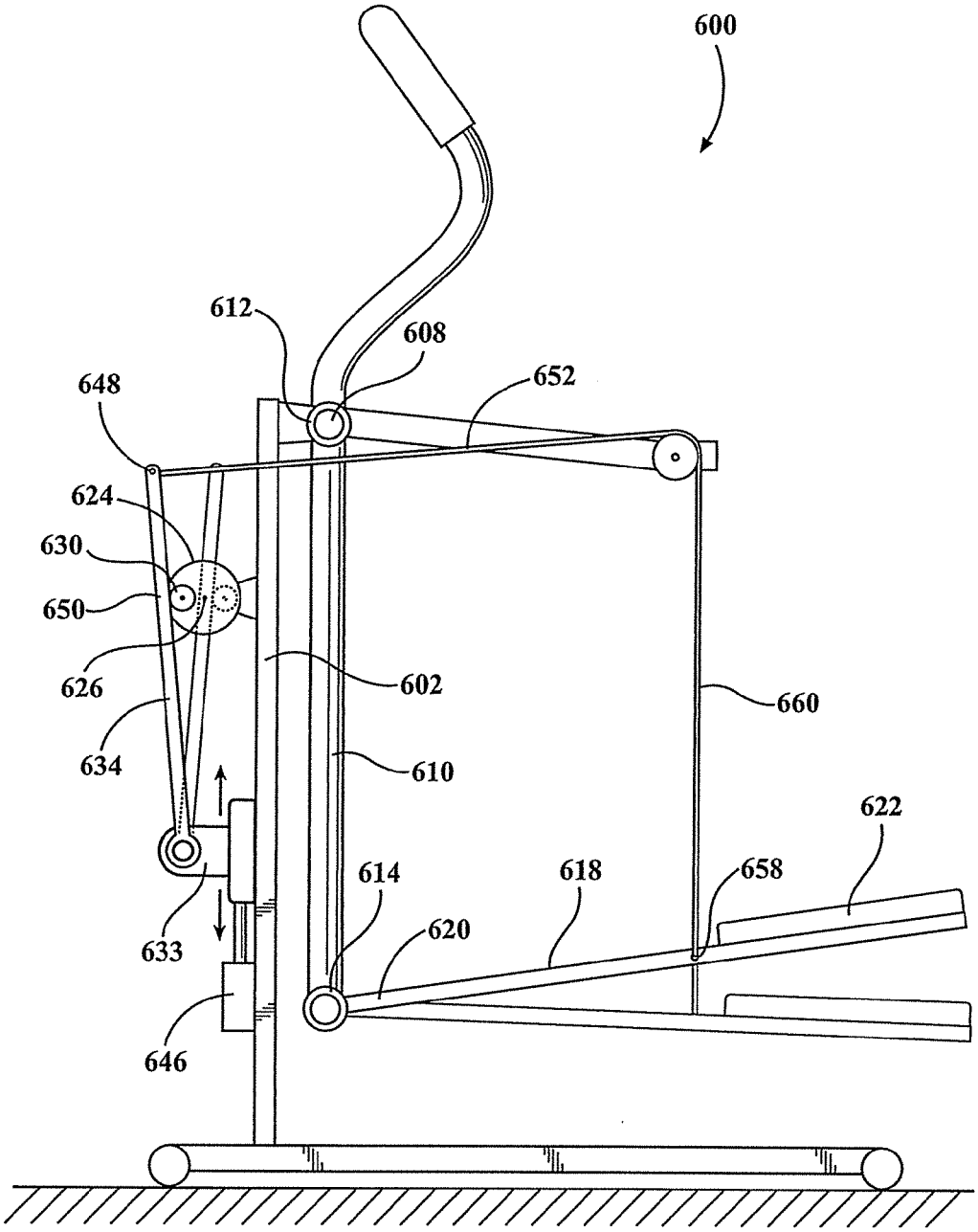
FIG. 11 is a side view of a sixth embodiment of an exercise device in accordance with the present invention.

Referring now to FIG. 11, a sixth embodiment of an exercise device in accordance with the present invention is shown generally at 600. The device has a frame 602 with a first pivot axis 608 defined thereon, a guide link 610 with a first attachment point 612 pivotally attached to the first axis 608 and a second attachment point at its lower end, a foot support link 618 having a forward end 620 pivotally attached to the second attachment point 614 and a rearward end defining a foot receiving area 622. The device 600 is a free stride type device wherein horizontal motion depends on the user. The device 600 includes a simplified vertical control system having a cam 624 attached to a second pivot axis on a frame at cam axis 626. The cam has a vertical control portion with offset portion 630. In this embodiment, the vertical follower support takes the form of a linearly movable follower support 633 mounted to the frame 602. The follower support 633 may be moved upwardly and downwardly on the frame by actuator 646. A vertical control follower 634 is pivotally attached to the follower support 633 and extends upwardly to an upper end that acts as a control portion 648. A mid portion 650 serves as a cam engagement portion and engages the offset portion 630. The control portion 648 is coupled to the foot support link 618 by a mechanical vertical control coupling, taking the form of flexible element 652. As with earlier embodiments, the flexible element 652 has a foot support portion 660 that is generally parallel to the guide link 610 and forms a parallelogram-type arrangement. The flexible element 652 is coupled to the foot support link 618 at coupling point 658. As will be clear to those of skill in the art, as the cam system 624 rotates about the cam axis 626, the foot receiving area 622 will be caused to move along a path of travel having a vertical component of motion. The exercise device of FIG. 11 may be made into a fixed path device by adding a horizontal control portion, such as those shown in FIG. 7 or 8. Alternatively, the cam and follower arrangement, and flexible element routing, of FIG. 11 may be substituted into other embodiments, such as the embodiments of FIGS. 4-10. Further combinations will be clear to those of skill in the art.

Figure 12:
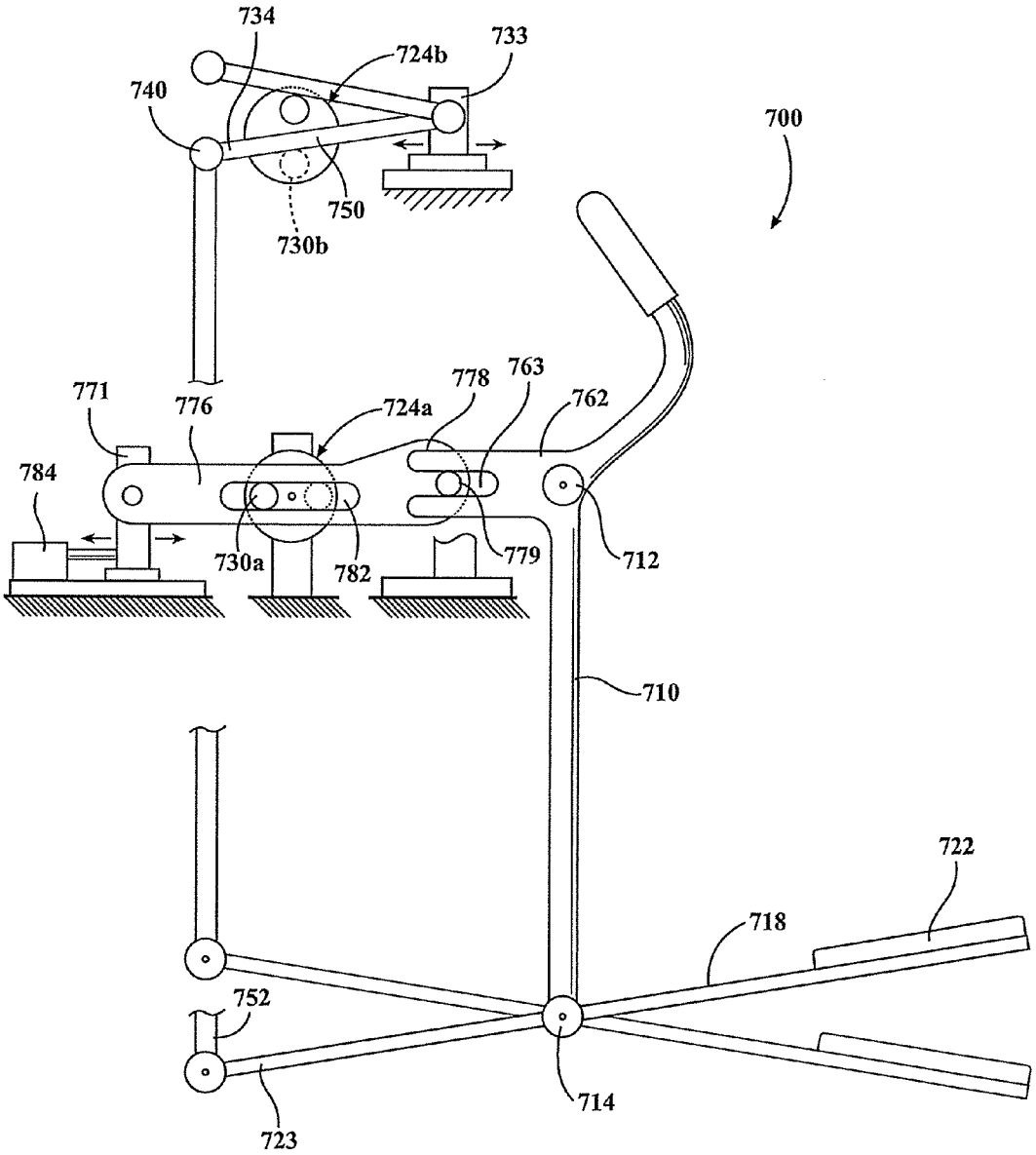
FIG. 12 is a side view of a seventh embodiment of an exercise device in accordance with the present invention.

Referring now to FIG. 12, portions of a seventh embodiment of an exercise device in accordance with the present invention are schematically illustrated at 700. The device 700 includes a guide link 710 with a first attachment point 712 that is pivotally attached to a frame, not shown, and a second attachment point 714 at its lower end. A foot support link 718 is pivotally attached to the second attachment point 714 at a mid portion thereof and has a foot receiving area 722 defined at a rearward end and an opposite forward end 723. In this embodiment, the horizontal and vertical aspects of the cam system are divided into two portions. A horizontal control cam portion is shown at 724*a* and a vertical control cam portion is shown at 724*b*, with each portion being rotatable about its own cam axis. The two portions 724*a* and 724*b* may be interconnected by a belt, chain, or other means so that they rotate in synchrony, or they may be uncoupled to allow independent rotation. Such a separated version of a cam system may be used with any embodiment of the present invention. In this embodiment, the vertical follower support takes the form of a linearly movable support 733 that may be mounted to the frame, not shown. A vertical control follower 734 is pivotally attached to the support 733 and has a control portion 740 at an opposite end and a mid portion 750 that engages the offset portion 730*b* of the cam portion 724*b*. A vertical control link 752 interconnects the control portion 740 of the follower 734 with the forward end 723 of the foot support link 718 such that rotation of the vertical control cam portion 724*b* causes motion of the foot receiving area 722 along a path of travel having a vertical component of motion. In this embodiment, the horizontal follower support takes the form of a linearly movable support 771 mounted to the frame, not shown. An actuator 784 may be used to adjust the position of the support 771 relative to the horizontal cam portion 724*a*. A horizontal control follower 776 is pivotally attached to the support 771 and has an opposite end serving as a control portion 778 and a mid portion with a cam engagement slot 782. The horizontal control cam portion 724*a* has an offset portion 730*a* that engages the slot 782 such that rotation of the horizontal control cam portion 724*a* causes the control portion 778 of the horizontal control follower 776 to move upwardly and downwardly. The guide link 710 has an attachment portion 762 with a slot 763 defined therein. The control portion 778 of the horizontal control follower 776 has a pin 779 extending therefrom that engages the slot 763 in the attachment portion 762 of the guide link 710. As such, the motion of the control portion 778 of the horizontal control follower 776 is translated into the guide link 710 being pivoted about the first attachment point 712, causing the foot receiving area 722 to move along a path of travel having a horizontal component of motion. As shown, the length of the slot 782 and slot 763 may be chosen such that the horizontal follower support 771 may be moved relative to the horizontal control cam portion 724*a* to allow adjustment in the range of horizontal travel.

Figure 13A:
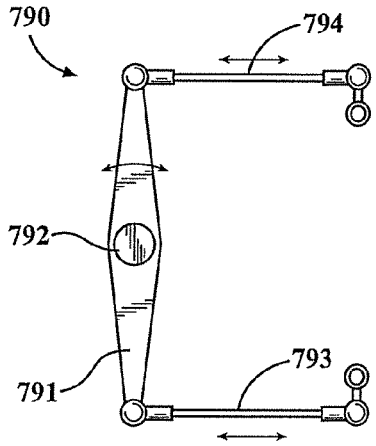
FIG. 13A is a view taken along lines 13A-13A of FIG. 13 showing the coordination linkage.
Figure 13:
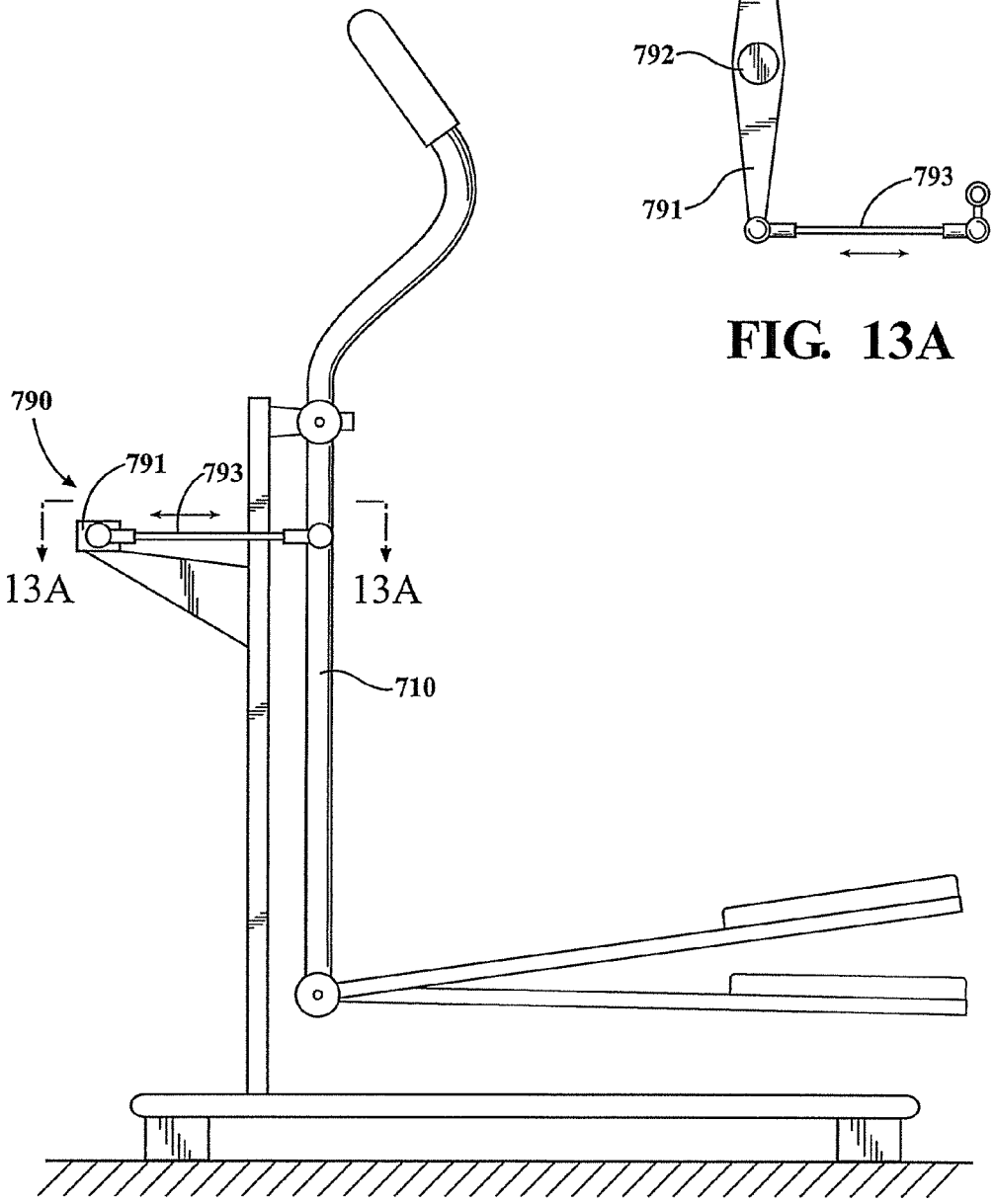
FIG. 13 is a side view of a portion of an exercise device showing a horizontal coordination mechanism that may be used with some embodiments of the present invention.

As will be clear to those of skill in the art, it is desirable in a free stride type exercise device to coordinate the movement of the foot receiving areas such that as one area moves rearwardly, the other area moves forwardly by an equal amount. FIGS. 13 and 13A illustrate one version of a horizontal coordination linkage 790 for providing such coordinated movement. The linkage 790 has a cross member 791 with a mid portion pivotally attached to the frame at 792. One end of the cross member 792 is interconnected with the left guide link 710 by a left link 793 and the other end is interconnected with the right guide link by a right link 794. It may also be desirable to provide resistance to this horizontal travel. Resistance may be provided in a variety of ways, such as a resistance element at the pivotal connection 792. An additional resistance element may be interconnected with the coordination linkage or with the individual guide links in other ways. A coordination linkage such as 790, or of other types, may be used with any embodiment of the present invention in which this type of coordination is desirable, typically a free stride type device. Resistance for horizontal motion may also be added to any embodiment.

Figure 14:
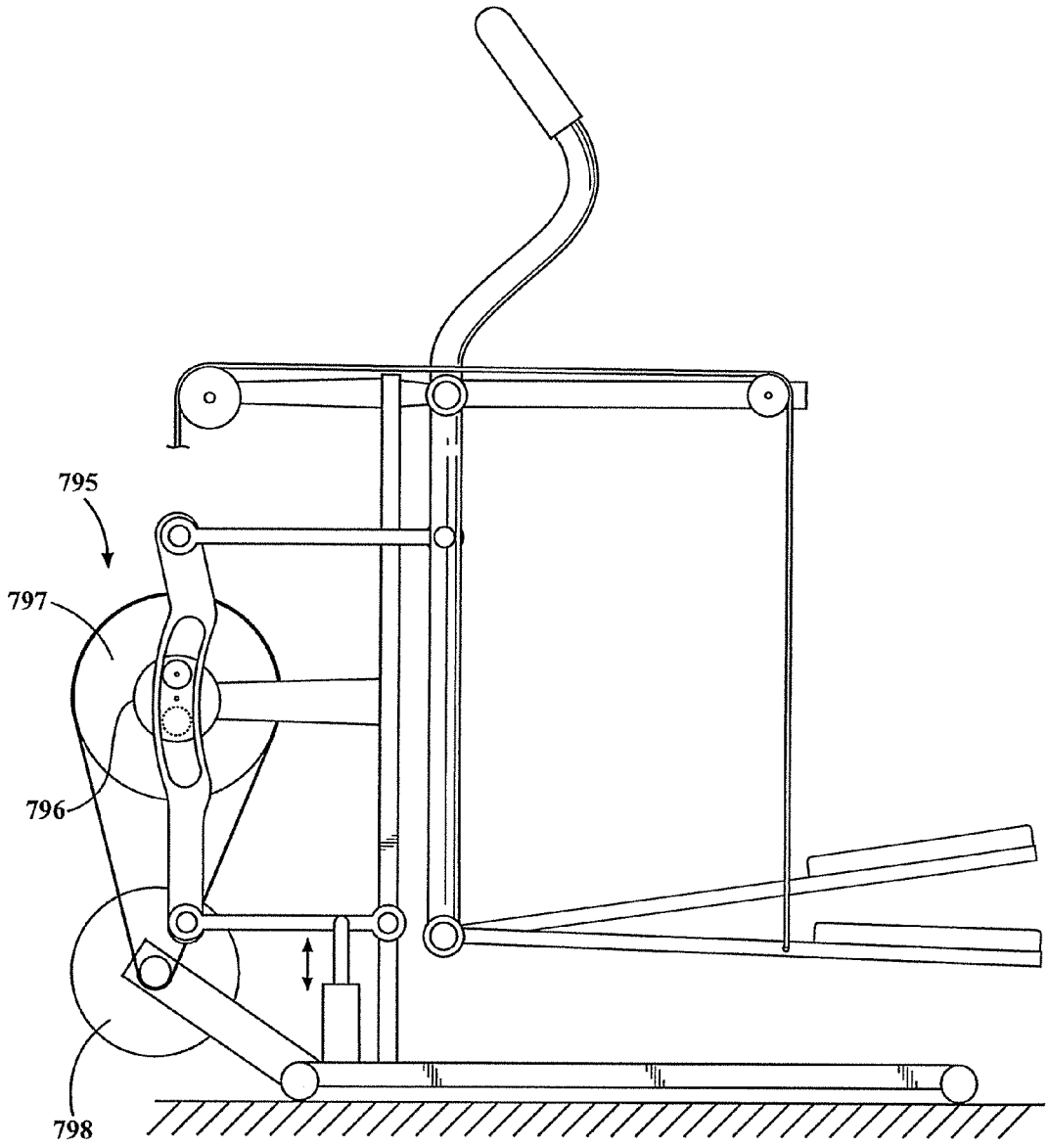
FIG. 14 is a side view of an exercise device showing a flywheel and resistance mechanism which may be used with embodiments of the present invention.

Referring now to FIG. 14, a resistance and flywheel system is generally shown at 795. A cam system 796 has a resistance wheel 797 attached thereto, to which resistance may be applied magnetically, electrically, or frictionally. A flywheel 798 is interconnected with the resistance wheel 797 by a belt but may be interconnected in other ways, or integrated with the resistance wheel. Other types of resistance may also be used. The remainder of the device shown in FIG. 14 is provided just for reference. The resistance and flywheel system 795, or other types of resistance and flywheel systems, may be used with any embodiment of the present invention.

Figure 15:
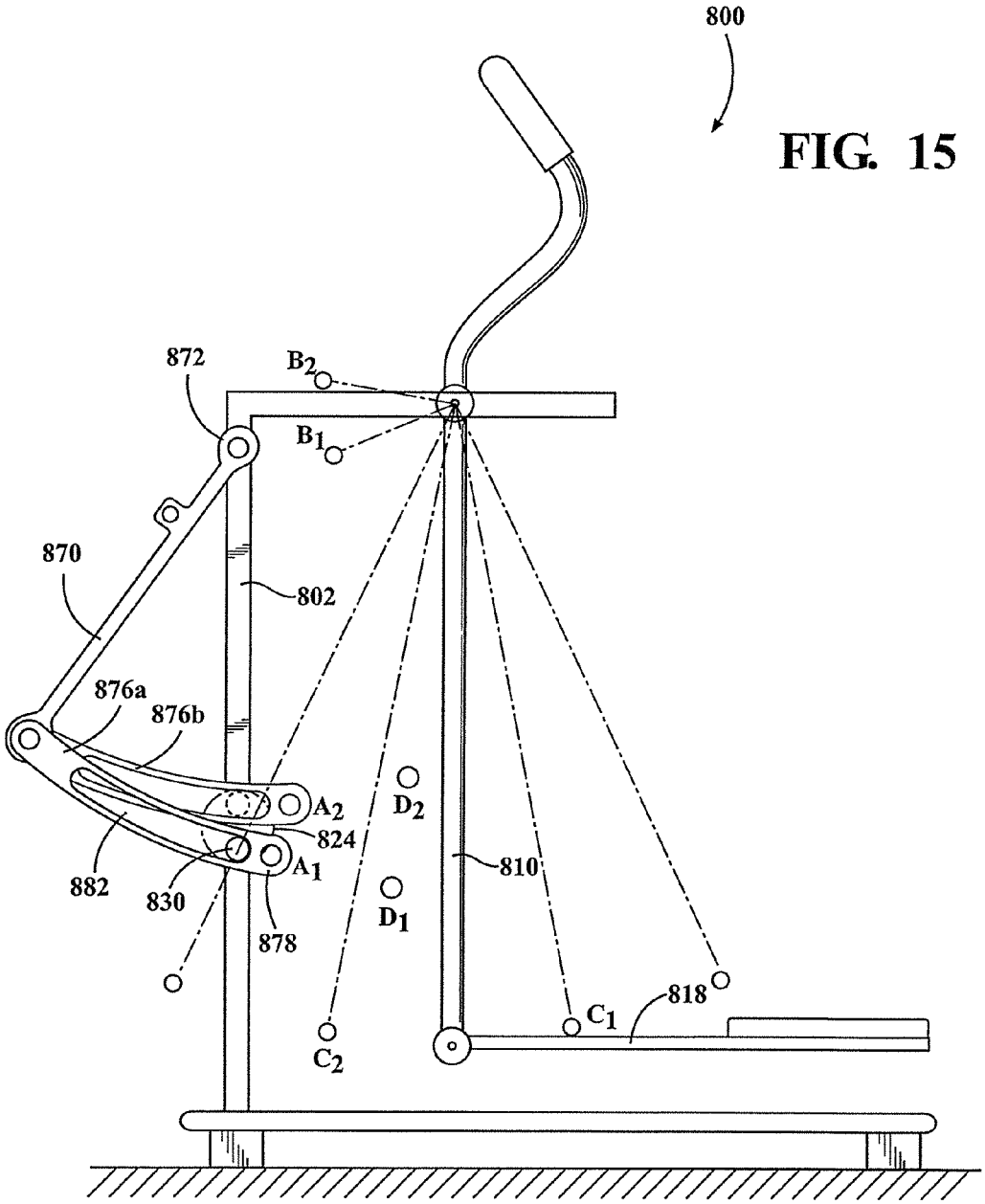
FIG. 15 is a side view of a portion of an exercise device in accordance with an eighth embodiment of the present invention.
Figure 16:
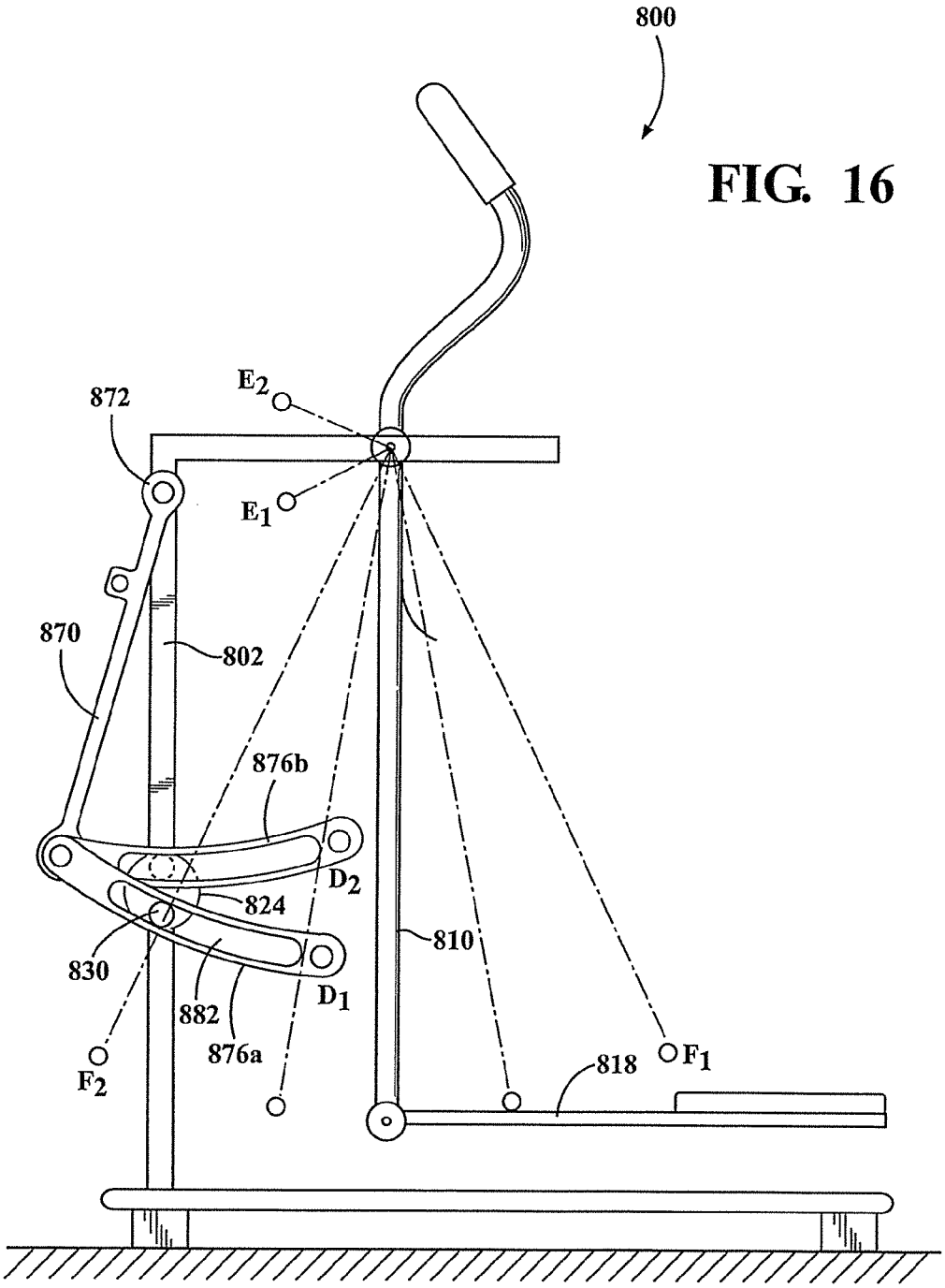
FIG. 16 is a side view similar to FIG. 15 with the follower support in a different position.

Referring now to FIGS. 15 and 16, portions of an eighth embodiment of the present invention are shown generally at 800. As with earlier embodiments, the device 800 includes a frame 802 that pivotally supports a guide link 810 and a foot support link 818 pivotally attached to the lower end of the guide link 810. A crank system 824 is shown pivotally supported on the frame midway between the upper and lower ends of the frame. A horizontal follower support link 870 is pivoted to the frame at 872 and extends generally downwardly to a follower end. Horizontal control followers 876*a* and 876*b* are pivotally interconnected with the lower end of the follower support link 870 and extend rearwardly so as to engage the cam system 824. The follower 876*a* represents the left follower and follower 876*b* represents the right follower. Alternatively, the illustrated followers 876*a* and 876*b* may represent the upper and lower positions of the follower resulting from rotation of the crank system 824. The followers have a cam engagement slot 882 engaging an offset portion 830 of the cam system 824. Comparing FIGS. 15 and 16, the follower end of the follower support link 870 is moved closer to the cam system 824 in FIG. 16 than in FIG. 15 resulting in increased travel of the control portion 878 of the horizontal control follower 876. In FIG. 15, the control portion 878 would travel from the position marked as A1 to the position marked as A2. Though not shown, the guide link 810 would have an attachment portion that extends forwardly and a horizontal control link would extend between the control portion 878 of the horizontal control follower 876 and this attachment portion. Such a link would extend between the location marked A1 and B1 or between position A2 and B2 depending on the position of the horizontal control follower 876. The movement of the attachment portion of the guide link 810 between positions B1 and B2 would cause the lower end of the guide link to move between the positions marked as C1 and C2. Referring now to FIG. 16, the control portion 878 of the horizontal control link 876 now travels between the positions marked as D1 and D2, and a link interconnecting D1 and E1 or D2 and E2 would cause the lower end of the guide link to swing between the positions marked as F1 and F2. It can be seen that this arrangement allows significant adjustability in the range of horizontal travel. While the embodiment of FIGS. 15 and 16 illustrates only an apparatus for controlling horizontal travel, similar apparatus may be provided instead for vertical travel, or for both horizontal and vertical travel. It is noted that the horizontal control follower 876 and the cam engagement slot 882 are both curved along the length of the follower.

Figure 17:
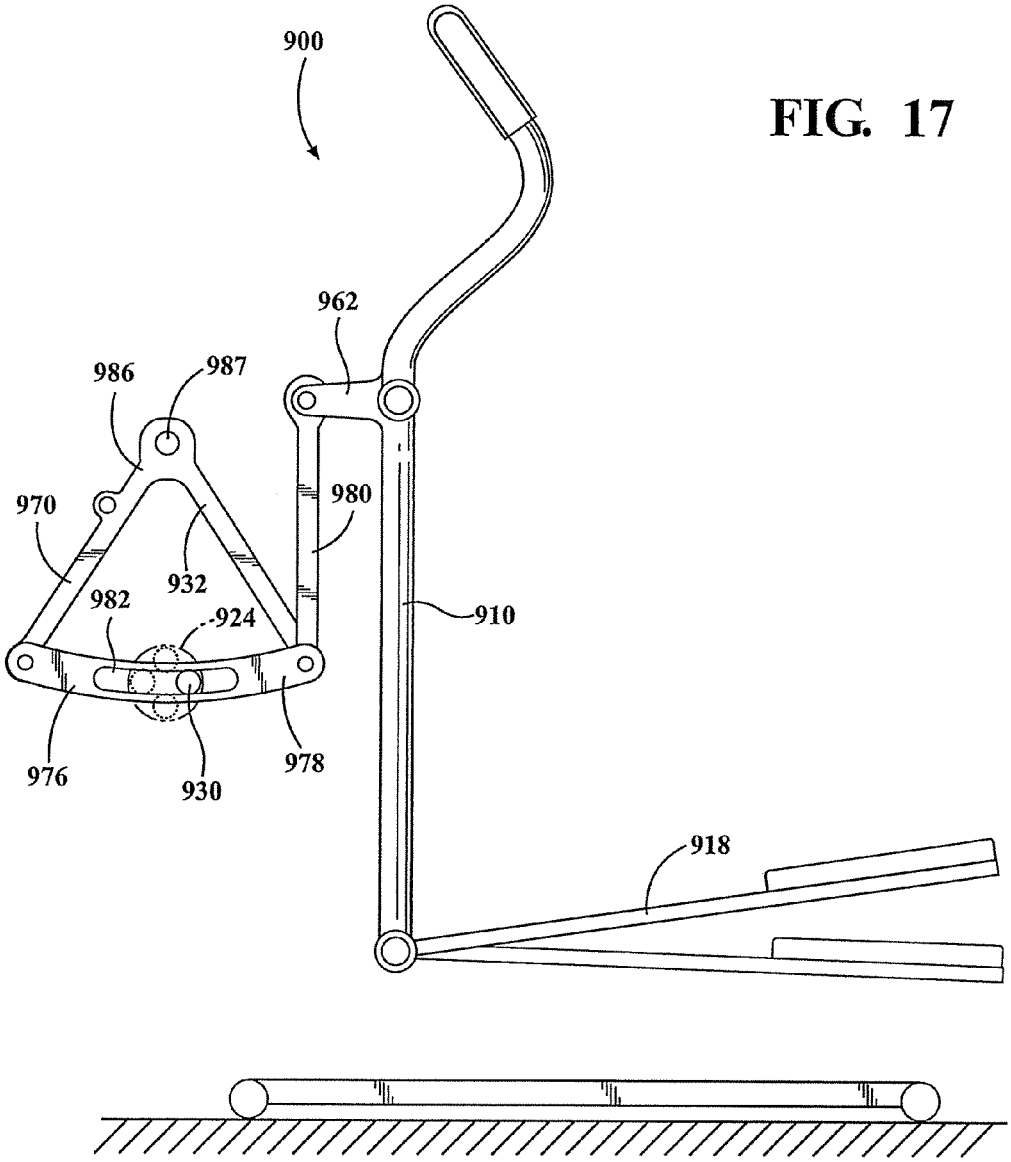
FIG. 17 is a side view of a portion of an exercise device in accordance with a ninth embodiment of the present invention, showing the horizontal control portions.
Figure 18:
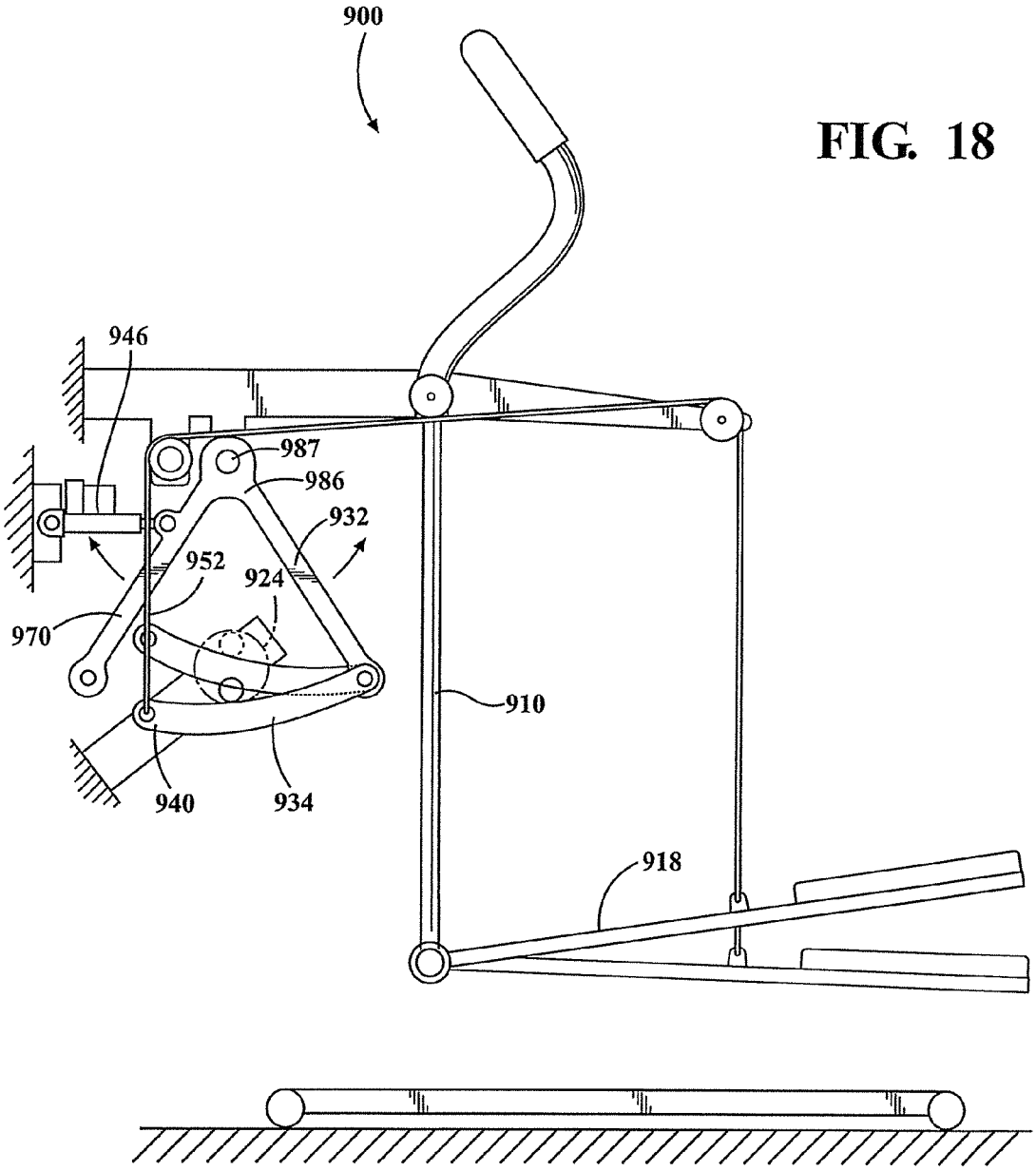
FIG. 18 is a side view of the ninth embodiment of an exercise device showing the vertical control portions.

Referring now to FIGS. 17 and 18, components of a ninth embodiment of an exercise device in accordance with the present invention are shown generally at 900. Many components are not illustrated in order to simplify the figures. FIG. 17 shows a guide link 910 and associated foot support link 918. The guide link has a forwardly extending attachment portion 962. This embodiment has a follower support rocker 986 that is shaped generally like an inverted V with the top end of the follower pivotally interconnected to the frame, not shown, at 987. The rocker 986 has a forward arm 970 that serves as a horizontal follower support link and a rear arm 932 that serves as a vertical follower support link. A horizontal control follower 976 has a forward end pivotally interconnected to the lower end of the horizontal follower support link 970 and extends rearwardly to a rearward end that serves as a control portion 978. A mid portion has a cam engagement slot 982 that engages the offset drive portion 930 of the cam system 924. A horizontal control link 980 links the control portion 978 of the horizontal control follower 976 to the attachment portion 962 of the guide link 910. Thereby, rotation of the cam system 924 causes pivotal movement of the guide link 910 and movement of the associated foot receiving area along a path of travel having a horizontal component of motion. FIG. 18 illustrates the vertical control portions of this embodiment. The follower support rocker 986 is now illustrated without the horizontal control follower. Instead, a vertical control follower 934 is pivotally connected to the lower end of the vertical follower support link 932 and extends forwardly to a control portion 940. A mid portion of the follower 934 engages the offset portion of the cam system 924. A flexible element 952 couples the control portion 940 of the vertical follower 934 to the respective foot support link 918 such that rotation of the cam system 924 causes movement of the foot receiving area along a path of travel having a vertical component of motion. An actuator 946 is attached to the rocker 986 so as to pivot the rocker and change the distance between the follower support links and the cam system 924, causing adjustment in both horizontal and vertical travel.

Figure 19:
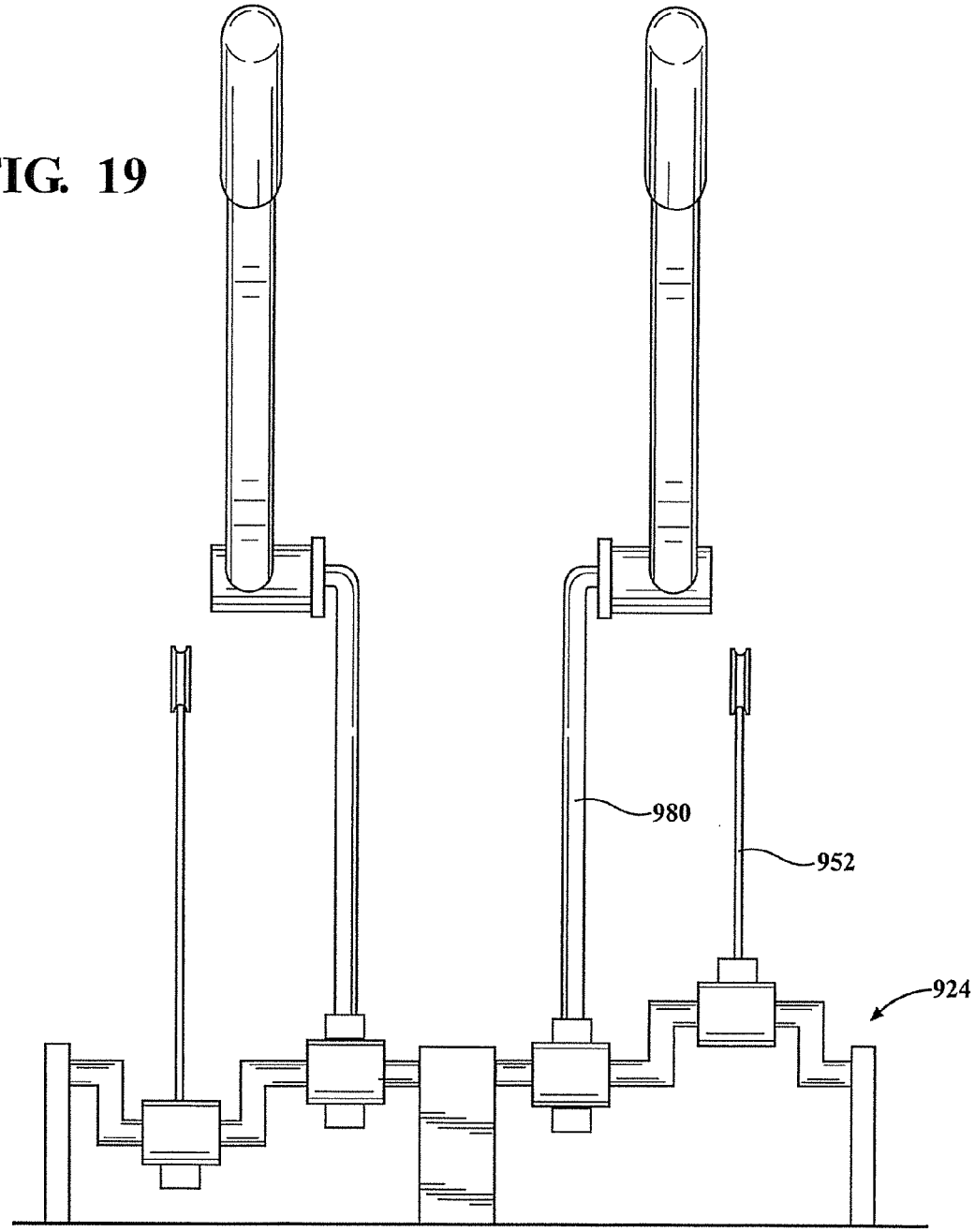
FIG. 19 is a front view of a portion of the ninth embodiment showing the relationship between the horizontal and vertical control portions.

Referring now to FIG. 19, portions of the horizontal and vertical controls are schematically illustrated to show the relationship between the cam system and the flexible elements and links. The cam system is shown at 924 and has two offset drive portions for controlling horizontal motion, which may be considered a horizontal control portion of the cam system. The cam system 924 further has two offset drive portions for vertical control, which may be considered a vertical control portion of the cam system. A portion of a flexible element is shown at 952 positioned above one of the outboard offset drive portions for vertical motion control and the horizontal control link 980 is shown positioned above one of the offset portions for horizontal motion control. As shown earlier, the link 980 and flexible element 952 are connected to followers, not directly to the cam system. Comparing the embodiment of FIGS. 17-19 with the embodiment of FIGS. 5-7, it can be seen that the cam system in the embodiment of FIGS. 17-19 is more complex in that the vertical and horizontal control portions are offset from one another by 90 degrees. In the embodiment of FIGS. 5-7, the horizontal and vertical control portions of the cam system for the left side of the machine are aligned with one another and the horizontal and vertical control portions for the right side are offset by 180 degrees with respect to the left side and are aligned with one another.

Figure 20:
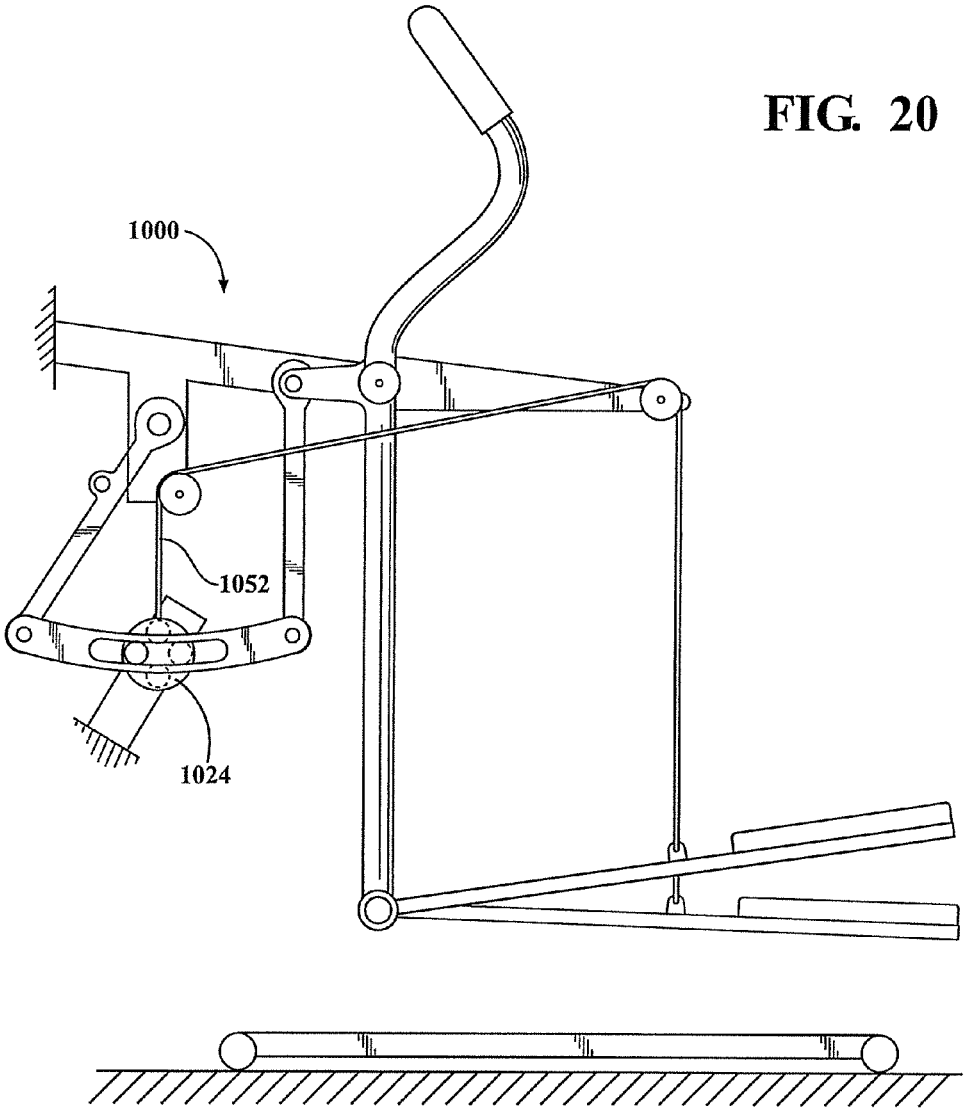
FIG. 20 is a side view of a tenth embodiment of an exercise device in accordance with the present invention.
Figure 21:
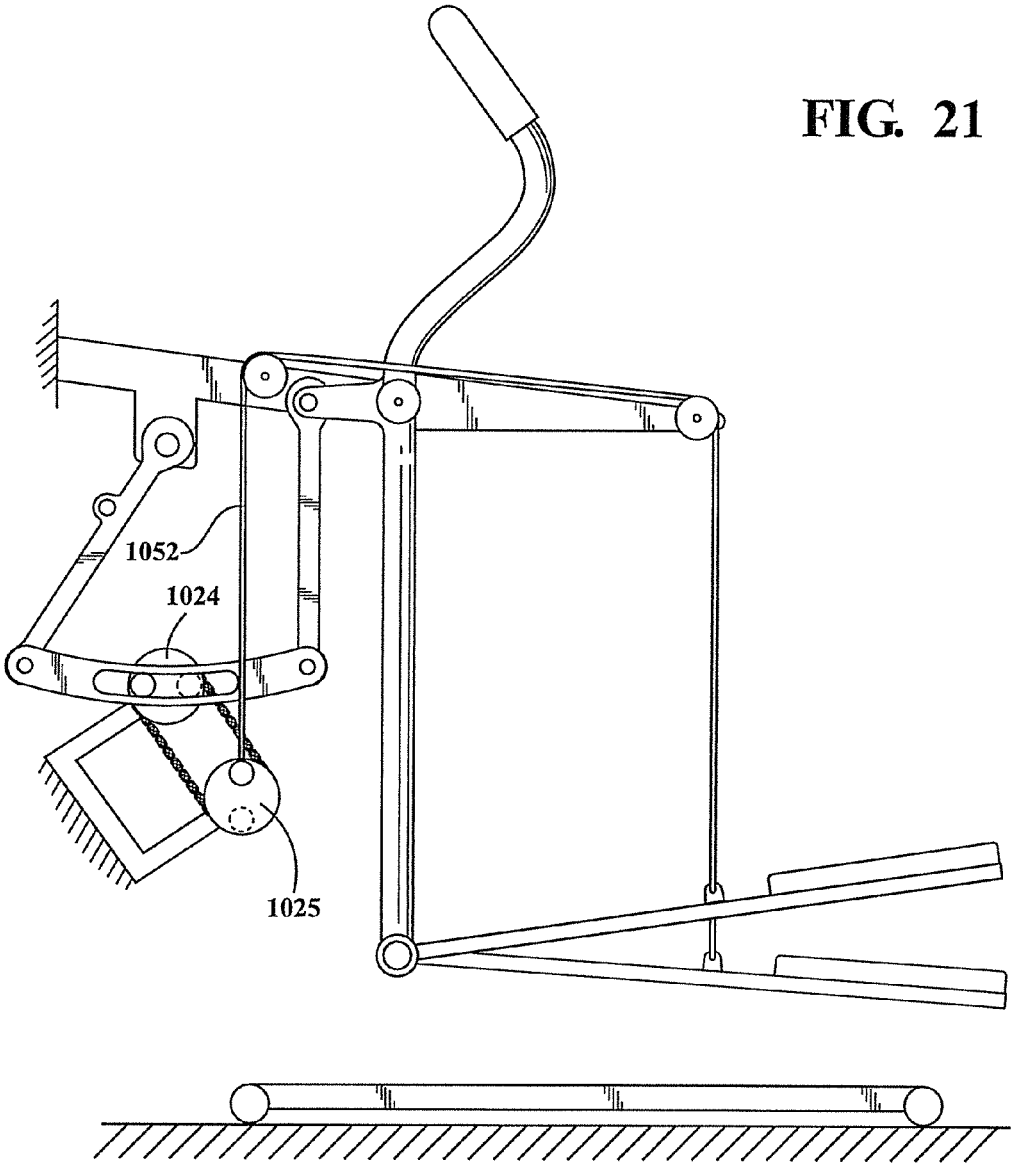
FIG. 21 is a side view of an eleventh embodiment of an exercise device in accordance with the present invention.

Referring now to FIG. 20, a tenth embodiment of an exercise device in accordance with the present invention is shown generally at 1000. This embodiment is somewhat similar to the embodiment of FIGS. 17-19, but has a flexible element 1052 directly connected to a portion of the cam system 1024 rather than using a cam and follower arrangement. FIG. 11 illustrates an alternative version of the embodiment of FIG. 20, in which the flexible element 1052 is connected to a crank 1025 that is offset from the remainder of the crank system 1024 and interconnected by a drive chain.

As will be clear to those of skill in the art, the embodiments of the present invention illustrated and discussed herein may be altered in various ways without departing from the scope or teaching of the present invention. Also, elements and aspects of one embodiment may be combined with elements and aspects of another embodiment. It is the following claims, including all equivalents, which define the scope of the present invention.

The invention claimed is:

1. An exercise device comprising:

a frame configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area configured to support a user's foot thereupon, each foot support link being pivotally connected to the second attachment point of a respective one of the guide links so that when the guide links pivot relative to the frame, they each cause the respective foot receiving area to move in a path of travel having a horizontal component of motion;

a cam system having a vertical control cam portion supported for rotation about a cam axis;

a vertical follower support disposed on the frame, the vertical follower support having a vertical follower pivot axis defined thereon;

a first and a second vertical control follower each pivotally connected to the vertical follower support at the vertical follower pivot axis, each vertical control follower further having a control portion and a cam engagement portion, the cam engagement portion engaging the vertical cam portion such that as the vertical cam portion rotates about the cam axis, the vertical control followers pivot back and forth about the vertical follower pivot axis thereby causing the control portions to oscillate back and forth; and a first and a second mechanical vertical control coupling each coupling a respective one of the foot support links to the control portion of a respective one of the vertical control followers such that as the vertical cam portion rotates about the cam axis, the mechanical vertical control couplings move the foot receiving areas of the foot support links in a path of travel having a vertical component of motion;

wherein the pivotal motion of the guide links about the first attachment points is decoupled from the motion of the foot receiving areas along the path of travel having a vertical component of motion so that the user can achieve a foot path that is generally vertical or a blend of vertical and horizontal motion.

2. An exercise device in accordance with claim 1, wherein:

the first and second mechanical vertical control couplings are flexible couplings each having one end coupled to the control portion of the respective vertical control follower and an opposite end coupled to the respective foot support link, each flexible coupling having a midportion extending over a guide disposed on the frame rearward of the first pivot axis;

each of the guide links has a guide length defined between the first and second attachment point;

each of the flexible couplings has a foot support portion extending between a coupling point on the respective foot support link and the guide on the frame, the foot support portion being generally parallel to the respective guide link throughout the motion of the device, the foot support portion further having a length that is similar to the guide length when the respective foot support link is at a midpoint of vertical travel; and the respective first attachment point, second attachment point, guide on the frame and coupling point on the foot support portion generally define a parallelogram when the respective foot support link is at the midpoint of vertical travel.

3. An exercise device in accordance with claim 2, wherein the vertical control followers each have a lower end pivoted to the vertical follower support and an upper end defining the control portion, the one end of each flexible coupling being coupled to the upper end of the respective vertical control follower and extending generally rearwardly to the guide.

4. An exercise device in accordance with claim 2, further comprising forward guides disposed on the frame forward of the first pivot axis, the mid portion of each flexible coupling further extending over a respective one of the forward guides.

5. An exercise device in accordance with claim 2, wherein the guides are guide pulleys pivotally mounted to the frame.

6. An exercise device in accordance with claim 1, wherein:

the vertical follower support is a movable support operable to move the vertical follower pivot axis relative to the respective cam axis so as to alter a range of travel of the control portion of the vertical control followers, thereby altering a range of the path of travel having a vertical component of motion; and further comprising a vertical control actuator operable to move the movable vertical follower support.

7. An exercise device in accordance with claim 6, wherein the vertical follower support is a vertical follower support link having a frame end pivotally connected to the frame and a follower end defining the vertical follower pivot axis, the vertical follower support link pivoting about the frame end so as to move the vertical follower pivot axis relative to the cam axis.

8. An exercise device in accordance with claim 6, wherein the vertical follower support is linearly displaceable on the frame.

9. An exercise device in accordance with claim 1, wherein the vertical control followers are curved.

10. An exercise device in accordance with claim 1, wherein each vertical follower is an elongated member having a cam engagement portion on a side surface of the elongated member.

11. An exercise device in accordance with claim 1, wherein the vertical control followers are elongated elements selected from the group consisting of:

each having one end pivotally connected to the vertical follower support, an opposite end defining the control portion, and a midportion defining a cam engagement portion;

each having one end pivotally connected to the vertical follower support, an opposite end defining a cam engagement portion, and a midportion defining the control portion; and each having one end defining a cam engagement portion, an opposite end defining the control portion, and a midportion pivotally connected to the vertical follower support.

12. An exercise device in accordance with claim 1, wherein the first and second mechanical vertical control couplings are vertical control links each having one end connected to the control portion of a respective one of the vertical control followers and a second end connected to a respective one of the foot support links forward of the second attachment point.

13. An exercise device in accordance with claim 1, wherein the cam axis is defined on the frame.

14. An exercise device in accordance with claim 1, further comprising an adjustable resistance element coupled to the cam system.

15. An exercise device in accordance with claim 1, further comprising a horizontal coordination linkage linking the first guide link to the second guide link such that pivotal movement of one of the guide links in a first direction causes pivotal movement of the other of the guide links in an opposite direction.

16. An exercise device in accordance with claim 15, further comprising an adjustable horizontal resistance element coupled to the guide links for providing resistance to the path of travel having a horizontal component of motion.

17. An exercise device in accordance with claim 1, wherein each of the guide links further includes a hand grip portion extending upwardly from the first attachment point.

18. An exercise device in accordance with claim 1, further comprising a sensor operable to sense movement of the guide links to determine a range of horizontal travel, wherein the amount of vertical travel is adjustable and is decreased as horizontal travel is increased.

19. An exercise device in accordance with claim 1, wherein the vertical control cam portion has a first and second offset portion, each offset portion comprising a cam lobe or an eccentric disk.

* * * * *